US011812531B1

(12) United States Patent
Cho

(10) Patent No.: US 11,812,531 B1
(45) Date of Patent: Nov. 7, 2023

(54) LED DRIVER AND DAC REFERENCE CIRCUIT THEREOF

(71) Applicant: RICHTEK TECHNOLOGY CORPORATION, Zhubei (TW)

(72) Inventor: Je-Kwang Cho, Hsinchu (TW)

(73) Assignee: RICHTEK TECHNOLOGY CORPORATION, Zhubei (TW)

( * ) Notice: Subject to any disclaimer, the term of this patent is extended or adjusted under 35 U.S.C. 154(b) by 0 days.

(21) Appl. No.: 18/049,703

(22) Filed: Oct. 26, 2022

Related U.S. Application Data

(60) Provisional application No. 63/404,631, filed on Sep. 8, 2022.

(51) Int. Cl.
*H05B 45/37* (2020.01)
*H05B 45/34* (2020.01)
*H05B 45/54* (2020.01)

(52) U.S. Cl.
CPC ..... *H05B 45/37* (2020.01); *H05B 45/34* (2020.01); *H05B 45/54* (2020.01)

(58) Field of Classification Search
None
See application file for complete search history.

(56) References Cited

U.S. PATENT DOCUMENTS 5,739,782 A * 4/1998 Uda ..... H03M 1/682 341/154
6,448,916 B1 * 9/2002 Leung ..... H03M 1/0663 341/154
7,304,596 B2 * 12/2007 Lin ..... H03M 1/682 341/145
9,928,870 B1 * 3/2018 Schapendonk ..... H03M 1/0836

* cited by examiner

*Primary Examiner* — Anh Q Tran
(74) *Attorney, Agent, or Firm* — Tung & Associates

(57) ABSTRACT

A digital-to-analog converter (DAC) for generating an output voltage according to an input code includes a first-type and a second-type sub-DAC's connected in series. The first-type sub-DAC includes a first resistor string and plural first switches, and receives a reference current to determine a first voltage drop. The first switches are controlled by a first portion of the input code to determine a voltage division of the first voltage drop. The second-type sub-DAC includes a second resistor string and plural second switches. The second switches are controlled by a second portion of the input code to determine a portion of the second resistor string to receive the reference current, wherein the portion of the second resistor string and the reference current determines a second voltage drop. The output voltage includes a sum of the second voltage drop and the voltage division of the first voltage drop.

23 Claims, 14 Drawing Sheets

LED DRIVER AND DAC REFERENCE CIRCUIT THEREOF

CROSS REFERENCE

The present invention claims priority to the provisional application Ser. No. 63/404,631, filed on Sep. 8, 2022, which application is incorporated herein by its reference in its entirety.

BACKGROUND OF THE INVENTION

Field of Invention

The present invention relates to an LED driver which includes a high resolution DAC reference circuit. The present invention also relates to a high resolution DAC reference circuit having smaller physical layout area for use in the LED driver.

Description of Related Art

For display panels, brightness control of an LED back-light system plays a critical role for saving overall system power and improving image quality (e.g. contrast ratio). These days, it is becoming a trend to employ as many local dimming zones as possible and make the local dimming resolution as fine as possible in order to achieve the above two goals, i.e. low power and high contrast ratio. Therefore, proportional numbers of LED drivers are employed corresponding to the increasing of the local dimming zones. The number of circuit components in the drivers is also increased, which is required for fine resolution of brightness control so as to achieve high contrast ratio. However, this inevitably results in large-sized LED drivers and thus may lead to a large-sized chip, if they are to be integrated in a single die, or require many separate chips for a single LED back-light system. To overcome this issue of large form factor and high cost, it is necessary to design a high-resolution LED driver occupying only a small area.

FIG. 1 shows a schematic diagram of a prior art back-light LED driver 901. The brightness control in the back-light LED driver can be performed by a digital-to-analog converter (DAC) in combination with a voltage-to-current converter which uses the DAC output voltage Vref as its input. The resolution of brightness control is determined by the resolution of the DAC. The B-bit DAC shown in FIG. 1 is a thermometer-type DAC which includes resistor strings combined with switches which selects one of the voltage division of the resistor string. The switches are controlled by the B-bit decoder which converts the B-bit DAC input code Din[B−1:0] to 2B control lines for controlling the switches. The number of circuit components of the DAC doubles (or quadruples) for every additional bit of the digital DAC input code.

The total number of the DAC circuit components depends on the type of the DAC. Binary-type DAC requires much less circuit components than thermometer-type DAC for a given resolution. However, the linearity characteristic of the binary-type DAC is much worse, resulting in poor accuracy of back-light brightness.

Still referring to FIG. 1, the output LED current (ILED) is controlled by a thermometer-type B-bit DAC. ILED is determined by feedback voltage (Vfb) divided by current sink resistor (Rcs). If the operational amplifier (OP) is ideal, the level of Vfb is equal to that of the DAC output voltage Vref. Since the DAC output voltage Vref is determined by turning on one of many switches in the B-bit DAC, Vref can be designed to be proportional to B-bit DAC input code, resulting in ILED proportional to the B-bit DAC input code. The DAC output voltage, Vref, is expressed as $$V_{ref}=I_{ref}\cdot R_{ref_u}\cdot(\text{decimal value of } Din[B-1:0]) \quad \text{Eq. (1)}$$

wherein $R_{ref_u}$ is the resistance of a unit reference resistor

One challenge of the thermometer-type DAC is that the physical layout area of thermometer-type DAC is often increased and determined by constraints of voltage and current rather than accuracy (or matching) property of the constituent components.

FIG. 2 shows a layout diagram of the resistors forming the resistor string of the DAC in FIG. 1. The maximum level of the DAC output voltage Vref, Vref_max, is typically designed to be 0.1V~0.2V, depending on the voltage headroom requirement of output voltage-controlled current-source stage. Since the DAC resolution in the LED driver is B bits, the voltage drop by a unit reference resistor is Vref_max/($2^B$−1). Then, for a given reference current (Iref), the resistance Rref_u can be calculated as Eq. (2):

$$R_{ref_u}=\frac{V_{ref_max}}{I_{ref}\cdot(2^B-1)} \quad \text{Eq. (2)}$$

For example, if Vref_max=0.2V, Iref=10 uA, and B=10, Rref_u should be designed to be around 20 ohms. It is also critical to consider another important specification of the DAC design, i.e. DAC linearity performance. For the case of the DAC in FIG. 1, matching property of Rref_u mostly determines the overall linearity of the DAC. Therefore, it is typical to use for example poly-silicon resistors, either P-type or N-type, for implementing Rref_u on a silicon integrated circuit chip.

However, since the resistance per square geometry (i.e. sheet resistance) of such poly-silicon resistors is typically several hundreds of ohms, Rref_u should be realized by connecting many unit-sized resistors in parallel. Assuming the unit-sized resistor of the parallel connection is Ru, the unit resistor of resistor string of the DAC in FIG. 1 is a stack of parallelly connected Ru's, as shown in FIG. 2. Assuming the number of such parallel connection of Ru's forming a unit resistor (Rref_u) is Np, the total number of Ru's needed for the B-bit DAC in FIG. 1 is $$\text{Total number of } Ru\text{'s in FIG. 1}=N_P(2^B-1) \quad \text{Eq. (3)}$$

This can be as large as several thousands of or even more than ten thousands of resistor components. In other words, the resistor part in the DAC can occupy a huge silicon area. Another drawback of the DAC in FIG. 1 is that it requires a B-bit decoder. Generally, the complexity, speed, and area of a decoder increase exponentially with every additional bit of a DAC. Therefore, if high resolution is desired, the approach shown in FIG. 1 may necessitate a large area for the B-bit decoder.

To overcome the problems described above, a new design technique is proposed in this invention for reducing the number of DAC circuit components. By segmenting the DAC into at least one thermometer-type sub-DAC combined with at least one switchable resistor sub-DAC, the number of total DAC circuit components can be greatly reduced while meeting accuracy specification required for the given resolution. Compared to the prior art in FIG. 1, the proposed circuit greatly reduces the area of resistors in the DAC in an LED back-light system. In addition, the decoder design in the DAC can also be significantly simplified, resulting in a much smaller area in the decoder as well. The potential inaccuracy issue caused by the proposed DAC architecture can be avoided with only small additional hardware.

SUMMARY OF THE INVENTION

From one perspective, the present invention provides a digital-to-analog converter (DAC) reference circuit, configured to operably generate a DAC output voltage according to a DAC input code, comprising: a first-type sub-DAC circuit, wherein the first-type sub-DAC includes a first resistor string and plural first switches, and receives a reference current to determine a first voltage drop, wherein the first switches are controlled by a first portion of the DAC input code to determine a voltage division of the first voltage drop; and at least one second-type sub-DAC circuit, connected in series with the first-type sub-DAC circuit, wherein the second-type sub-DAC includes a second resistor string and plural second switches, wherein the second switches are controlled by a second portion of the DAC input code to determine a portion of the second resistor string to be connected to the first resistor string and to receive the reference current, wherein the portion of the second resistor string and the reference current determines a second voltage drop; wherein the DAC output voltage includes a sum of the second voltage drop and the voltage division of the first voltage drop.

In one preferred embodiment, the first resistor string includes a first number of first-type resistors which are coupled in series and receives the reference current to generate the first voltage drop across the first resistor string, wherein the first switches are configured to operably select the voltage division of the first voltage drop from an end of one of the first-type resistors according to the first portion of the DAC input code; and wherein the second resistor string includes a second number of second-type resistors which are coupled in series, wherein one of the second switches is turned on, according to the second portion of the DAC input code, to build up a current path for the reference current to an end of one of the second-type resistors, so as to select the portion of the second resistor string to be connected in series to the first resistor string and to receive the reference current to generate the second voltage drop across the portion of the second resistor string.

In one preferred embodiment, each of the first resistor has a first resistance and each of the second resistor has a second resistance, wherein a resistance ratio of the first resistance to the second resistance is equal to or larger than the second number when the first portion of the DAC input code is a higher portion than the second portion of the DAC input code, or the resistance ratio is equal to or smaller than a reciprocal of the first number when the second portion of the DAC input code is a higher portion than the first portion of the DAC input code.

In one preferred embodiment, each of the first resistors and each of the second resistors are formed by a predetermined material on an integrated circuit, wherein one of the first resistor and the second resistor having a lower resistance is referred to as a small resistor having a small resistance and one of the first resistor and the second resistor having a higher resistance is referred to as a large resistor having a large resistance; wherein a first aspect ratio of physical layout of the small resistor is large to an extent that a second aspect ratio of physical layout of the large resistor is smaller than the first aspect ratio and that an area of physical layout of the large resistor is smaller than an area of physical layout of the small resistor; wherein each of the first aspect ratio and the second aspect ratio is defined by a width divided by a length of physical layout of the corresponding resistor, wherein the reference current flows in a direction along the length.

In one preferred embodiment, the first aspect ratio of physical layout of the small resistor is larger than 1, or larger than 5, or larger than 1/10, wherein the first aspect ratio is determined by a maximum level of the DAC output voltage, the reference current, a decimal number of the DAC input code and a resistance per square of the predetermined material.

In one preferred embodiment, a length of each of the first resistor is the same as a length of each of the second resistor.

In one preferred embodiment, for layout arrangement, each of the first resistor is arranged by a third number of unit resistors connected in parallel and each of the second resistor is arranged by a fourth number of unit resistors connected in parallel, wherein the ratio of the third number to the fourth number is related to the ratio of the first aspect ratio to the second aspect ratio.

In one preferred embodiment, a resistance per square of the predetermined material is larger than the small resistance to the extent that a second aspect ratio of physical layout of the large resistor is smaller than the first aspect ratio and that an area of physical layout of the large resistor is smaller than an area of physical layout of the small resistor.

In one preferred embodiment, the resistance per square of the predetermined material is smaller than a unit resistance of the unit resistor.

In one preferred embodiment, one of the first-type sub-DAC circuit and the second-type sub-DAC circuit having the small resistor is controlled by a lower portion of the DAC input code, and the other of the first-type sub-DAC circuit and the second-type sub-DAC circuit having the large resistor is controlled by a higher portion of the DAC input code.

In one preferred embodiment, the DAC reference circuit includes plural second-type sub-DAC circuits, wherein the plural second-type sub-DAC circuits and the first-type sub-DAC circuit are coupled in series with the reference current; wherein the DAC output voltage includes a sum of the voltage drop across the first-type sub-DAC circuit and voltage drops across the plural second-type sub-DAC circuits; wherein the higher the portion of the DAC input code is configured to control one sub-DAC circuit among the plural second-type sub-DAC circuits and the first-type sub-DAC circuit, the higher a resistance of the first resistor or the second resistor of the one sub-DAC circuit is; a resistance of the first resistor or the second resistor of the corresponding first-type sub-DAC circuit or the corresponding plural second-type sub-DAC circuits is quadratically proportional to an order of the corresponding portion of the DAC input code, wherein the higher the order of the corresponding portion of the DAC input code occupies, the higher the resistance is.

In one preferred embodiment, the DAC reference circuit further comprises a decoder circuit which includes a first sub-decoder and a second sub-decoder, wherein the first sub-decoder is configured to operably receive and decode the first portion of the DAC input code to generate plural first control signals to control the first switches respectively, and the second sub-decoder is configured to operably receive and decode the second portion of the DAC input code to generate plural second control signals to control the second switches.

In one preferred embodiment, the DAC reference circuit is for use in generating a driving current in association with a voltage to current converter, wherein the voltage to current converter includes an amplifier and a driving transistor, wherein the amplifier controls the driving transistor to generate the driving current according to the DAC output voltage.

In one preferred embodiment, the voltage to current converter further includes an offset circuit coupled to a feedback path of the amplifier, wherein the offset circuit includes: at least one current source, wherein a level of the at least one current source is related to the reference current; and at least one offset switch which is constantly on and configured to receive the at least one current source, wherein a voltage drop across the at least one offset switch cancels out an error voltage of the DAC output voltage, wherein the error voltage is caused by at least one second switch through which the reference current flows, wherein an equivalent on-resistance of the at least one offset switch is related to an on-resistance of the second switch.

In one preferred embodiment, the DAC reference circuit further comprises an offset circuit coupled to the first sub-DAC circuit, wherein the offset circuit includes: at least one current source, wherein a level of the at least one current source is related to the reference current; and at least one offset switch which is constantly on and configured to receive the at least one current source, wherein a voltage drop across the at least one offset switch cancels out an error voltage of the DAC output voltage, wherein the error voltage is caused by at least one second switch through which the reference current flows, wherein an equivalent on-resistance of the at least one offset switch is related to an on-resistance of the second switch.

From another perspective, the present invention provides a light emitting diode (LED) driver, configured to generate a driving current according to a DAC input code, comprising: a digital-to-analog converter (DAC) reference circuit, configured to generate a DAC output voltage according to the DAC input code; and a voltage to current converter, which includes an amplifier and a driving transistor, wherein the amplifier controls the driving transistor to generate the driving current according to the DAC output voltage; wherein the DAC reference circuit includes: a first-type sub-DAC circuit, wherein the first-type sub-DAC includes a first resistor string and plural first switches, and receives a reference current to determine a first voltage drop, wherein the first switches are controlled by a first portion of the DAC input code to determine a voltage division of the first voltage drop; and at least one second-type sub-DAC circuit, connected in series with the first-type sub-DAC circuit, wherein the second-type sub-DAC includes a second resistor string and plural second switches, wherein the second switches are controlled by a second portion of the DAC input code to determine a portion of the second resistor string to be connected to the first resistor string and to receive the reference current, wherein the portion of the second resistor string and the reference current determines a second voltage drop; wherein the DAC output voltage includes a sum of the second voltage drop and the voltage division of the first voltage drop.

The objectives, technical details, features, and effects of the present invention will be better understood with regard to the detailed description of the embodiments below, with reference to the attached drawings.

DESCRIPTION OF THE PREFERRED EMBODIMENTS

The drawings as referred to throughout the description of the present invention are for illustration only, to show the interrelations between the circuits and the signal waveforms, but not drawn according to actual scale of circuit sizes and signal amplitudes and frequencies.

Figure 3:
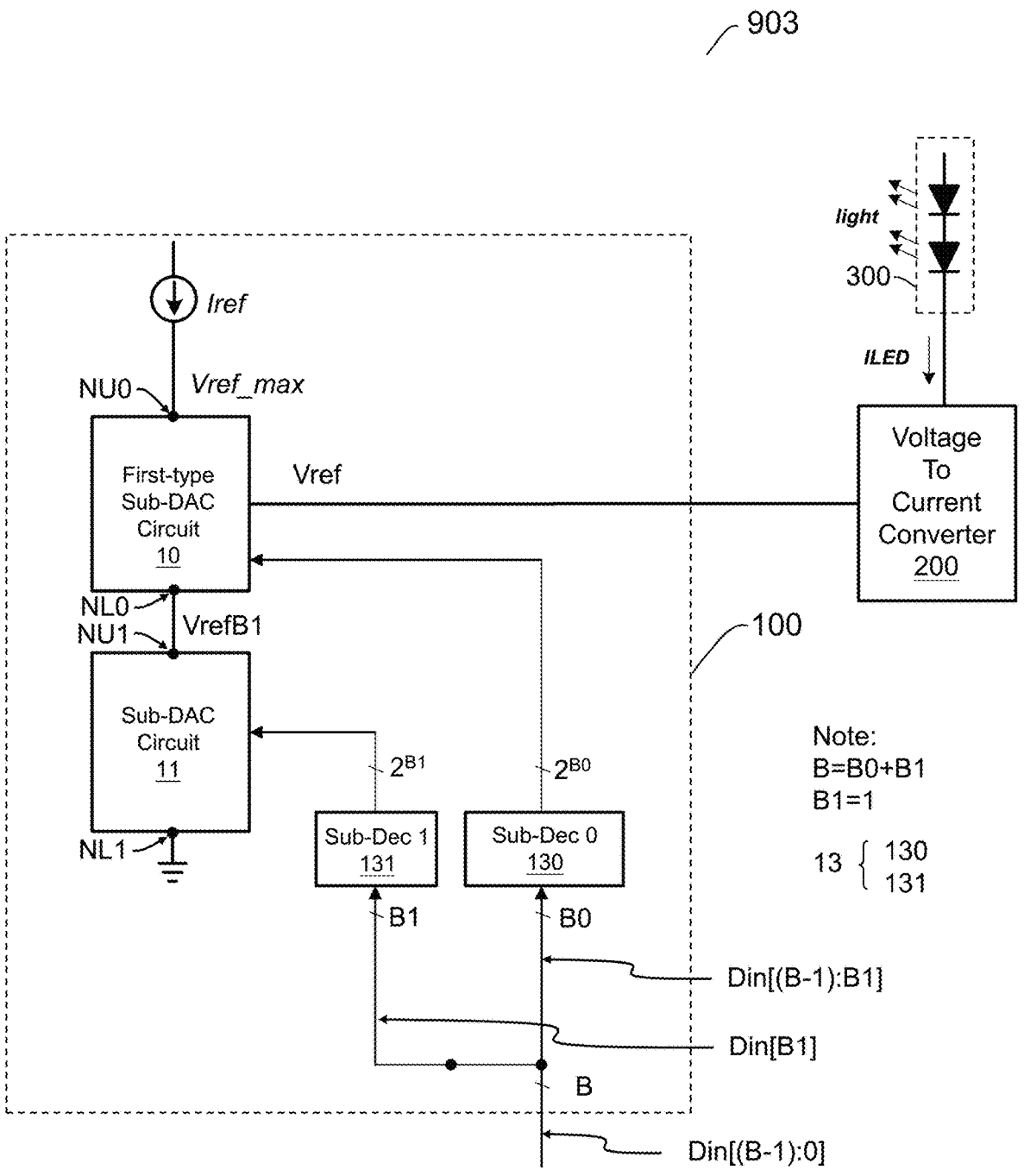
FIG. 3 shows a block diagram of an LED driver (903) according to an embodiment of the present invention.

FIG. 3 shows a block diagram of an LED driver (903) according to an embodiment of the present invention. The LED driver 903 comprises a DAC reference circuit 100 and a voltage to current converter 200. The DAC reference circuit 100 is configured to generate a DAC output voltage Vref according to a B-bit DAC input code Din[B−1:0]. The voltage to current converter 200 is configured to generate an LED (light emitting diode) current ILED according to the DAC output voltage Vref.

In one embodiment, the DAC reference circuit 100 includes a first-type sub-DAC circuit 10, a second-type sub-DAC circuit 11 and decoder circuit 13. The first-type sub-DAC circuit 10 includes a thermometer-type resistor structure which is controlled by upper B0 bits of the DAC input code. The second-type sub-DAC circuit 11 includes a switchable resistor string structure which is controlled by the rest less significant B1 bits of the DAC input code. In one embodiment, the first-type sub-DAC circuit 10 and the second-type sub-DAC circuit 11 are coupled in series to generate the DAC output voltage Vref.

In one embodiment, a reference current Iref is applied to an upper terminal NU0 of the first-type sub-DAC circuit 10. A lower terminal NL0 of the first-type sub-DAC circuit 10 is connected to the upper terminal NU1 of the second-type sub-DAC circuit 11. A lower terminal NL1 of the second-type sub-DAC circuit 11 is connected to a ground node. The DAC output voltage Vref is a sum of a voltage drop (i.e. VrefB1–0=VrefB1) across the second-type sub-DAC circuit 11 and a voltage division of the voltage drop across the first-type sub-DAC circuit 10. The voltage drop (i.e. Vref_max–VreB1) across the first-type sub-DAC circuit 10 is a product of the total series resistance of the first-type sub-DAC circuit 10 and the reference current Iref. The voltage division ratio of the voltage drop (Vref_max–VreB1) is controlled by the upper B0 bits of the DAC input code. The voltage drop VrefB1 across the second-type sub-DAC circuit 11 is a product of the series resistance of second-type sub-DAC circuit 11 and the reference current Iref, wherein the series resistance of second-type sub-DAC circuit 11 is controlled by the B1 bits of the DAC input code.

Figure 4:
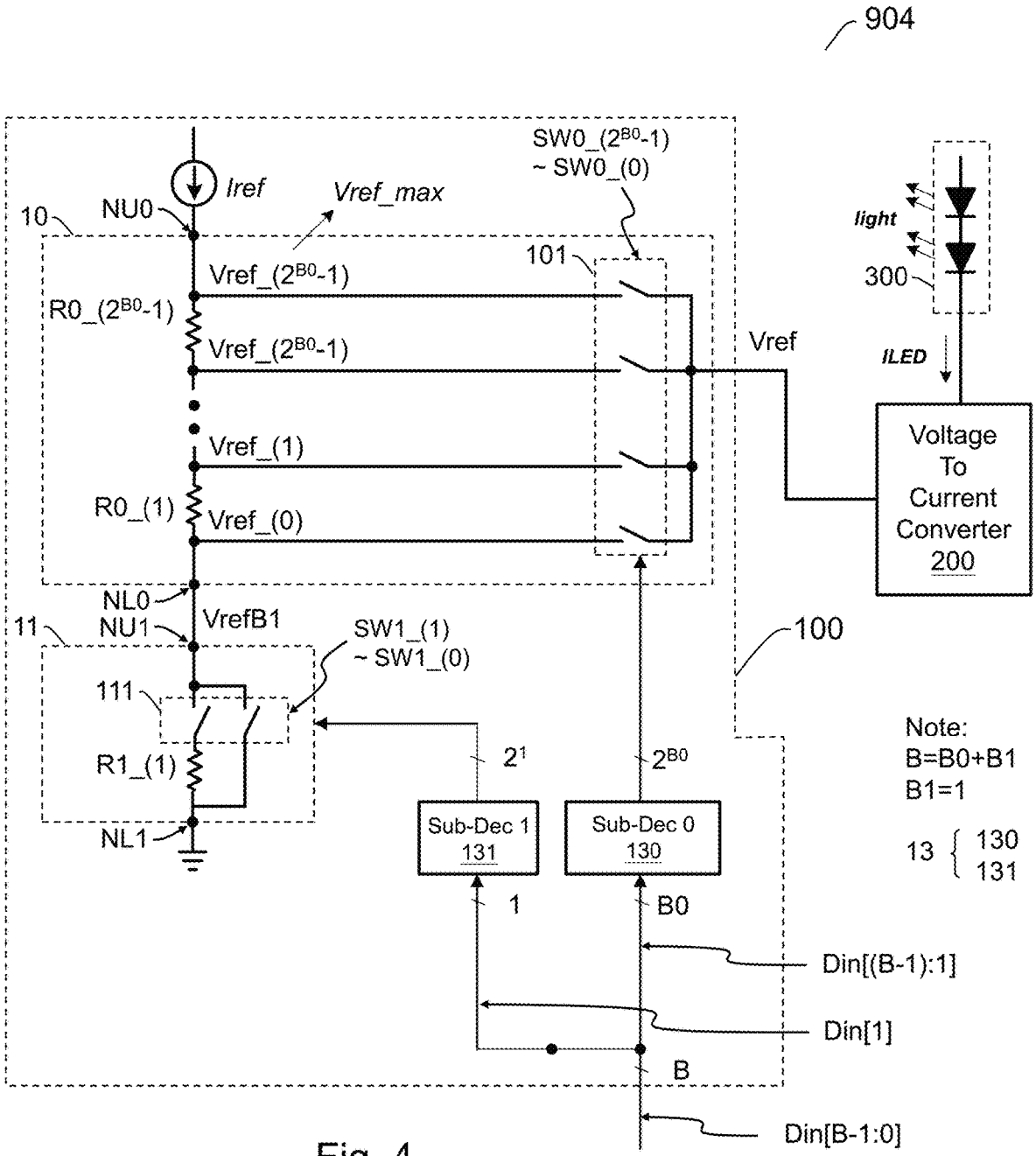
FIG. 4 shows a schematic diagram of an LED driver according to an embodiment of the present invention.

FIG. 4 shows a schematic diagram of an LED driver (904) according to an embodiment of the present invention. In one embodiment, the first-type sub-DAC circuit 10 includes a first resistor string and a switch network 101. The first resistor string includes plural resistors R0_(1)~R0_($2^{B0}$–1) which are connected in series between the upper terminal NU0 and the lower terminal NL0. The switch network 101 includes corresponding number of plural switches SW0_(0)~SW0_($2^{B0}$–1). Each of the resistors R0_(1) R0_($2^{B0}$–1) has identical resistance of 2*Rref_u. One end of the switches SW0_(0)~SW0_($2^{B0}$–1) is connected respectively to the lower end of the resistor R0_(1), joint nodes between any two neighboring resistors R0_(1)~R0_($2^{B0}$–1), and the upper end of R0_($2^{B0}$–1). All the other ends of the switches SW0_(0)~SW0_($2^{B0}$–1) are connected together to generate the DAC output voltage Vref.

The switches SW0_(0)~SW0_($2^{B0}$–1) are configured to conduct one of the voltage division Vref (0)~Vref ($2^{B0}$–1) selected from the first resistor string, selected by the upper B0-bit DAC input code, to be the DAC output voltage Vref.

In one embodiment, the second-type sub-DAC circuit 11 in FIG. 4 includes one resistor R1_(1) which has resistance of Rref_u, and corresponding number of switches SW1_(0)~SW1_(1). The switches SW1_(0)~SW1_(1) are configured to select either the upper terminal or the lower terminal of the resistor R1_(1), by the least significant bit (LSB) of the DAC input code, to be conducted to the upper terminal NU1. Note that in this specific embodiment, the bit number B1 of the second-type sub-DAC circuit 11 is 1, and the bit number B0 of the first-type sub-DAC circuit 10 is B0, wherein B=B0+1.

Assuming the on-resistance of each of the switches SW1_(0)~SW1_(1) is Rsw, the bottom voltage of the upper B0-bit resistor string, Vref_0, in FIG. 4 (i.e. the voltage drop VrefB1) is either Iref*Rsw when Din[0]=0 or Iref*(Rsw+Rref_u) when Din[0]=1. Thus, the DAC output voltage Vref can then be derived as $$\begin{aligned}\text{Vref}&=I_{ref}\cdot(R_{SW}+R_{ref_u}\cdot Din[0])+I_{ref}\cdot(2\cdot R_{ref_u}\cdot(\text{decimal value of } Din[B-1:1]))\\&=I_{ref}\cdot R_{ref_u}\cdot(Din[0]+2\cdot(\text{decimal value of } Din[B-1:1]))+I_{ref}\cdot R_{SW}\\&=I_{ref}\cdot R_{ref_u}\cdot(\text{decimal value of } Din[B-1:0])+I_{ref}\cdot R_{SW}\end{aligned}\quad \text{Eq. (4)}$$

Eq. (4) is almost identical with Eq. (1) except that Eq. (4) has an error voltage, Iref*Rsw. However, this error voltage Iref*Rsw can be easily cancelled out by some additional offset cancellation circuit, which will be explained in detail later.

Still referring to FIG. 4, the decoder circuit 13 includes a sub-decoder 130 (noted as sub-dec 130 in FIG. 4) and a sub-decoder 131 (noted as sub-dec 131 in FIG. 4). In this embodiment, the sub-decoder 130 and the sub-decoder 131 are configured to decode the upper B0 bits of the DAC input code to $2^{B0}$ control lines for controlling switches and to decode the lower B1 bit (i.e. the LSB) of the DAC input code to $2^{B1}$ control lines for controlling switches respectively.

Figure 5:
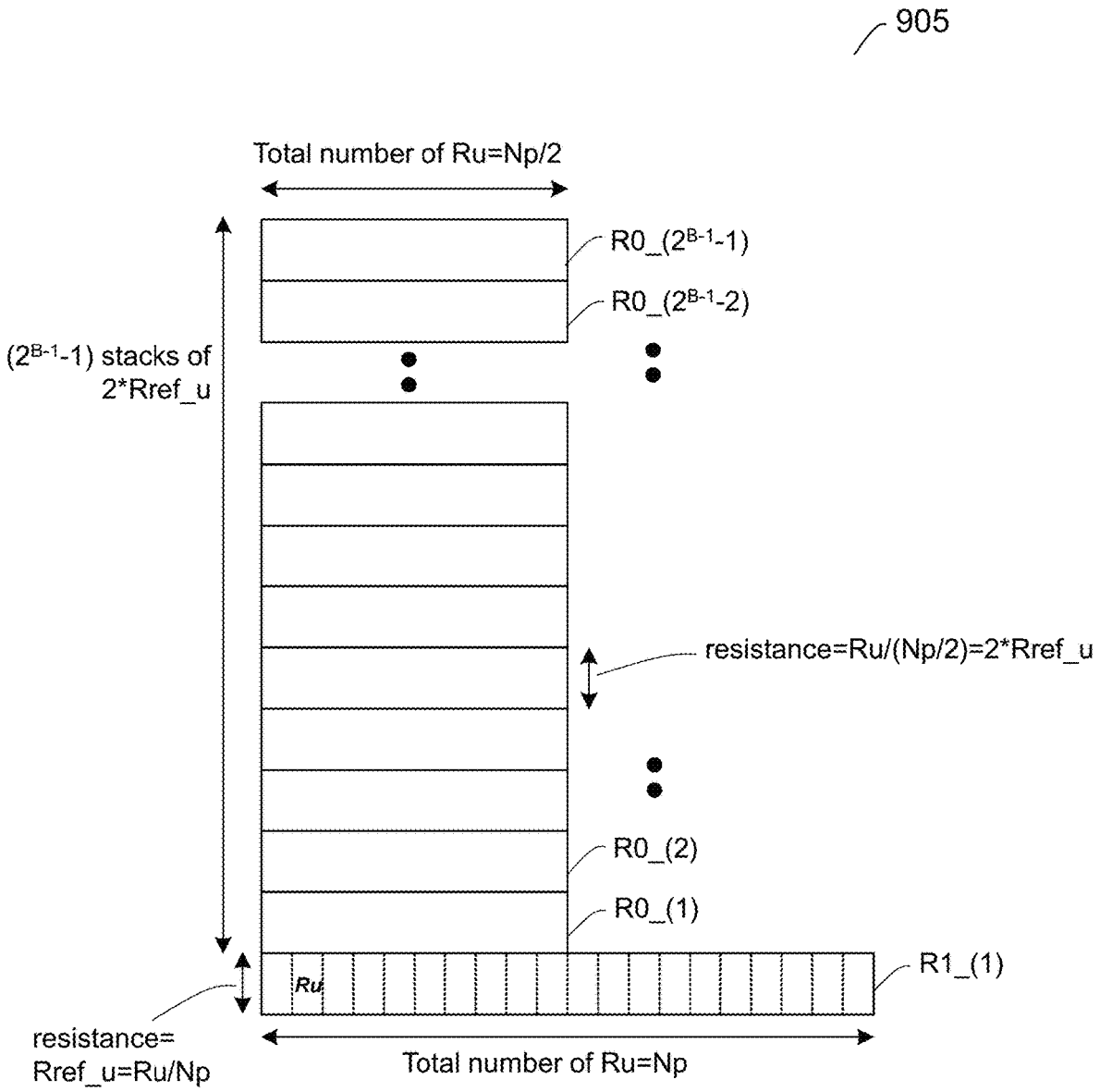
FIG. 5 shows a layout diagram of the resistors forming the resistor string of the DAC in FIG. 4.

FIG. 5 shows a layout diagram of the resistors forming the resistor string of the DAC in FIG. 4. Each of the resistors R0_(1)~R0_($2^{B0}$–1) having resistance of 2*Rref_u in FIG. 4 can be physically implemented using a parallel connection of only (Np/2) Ru's, as shown in FIG. 5. Thus, the total number of Ru's in FIG. 5 becomes $$\text{Total number of Ru's in Fig. 5} = N_P + \left(\frac{N_P}{2}\right)\cdot(2^{B-1}-1) \quad \text{Eq. (5)}$$

Figure 1:
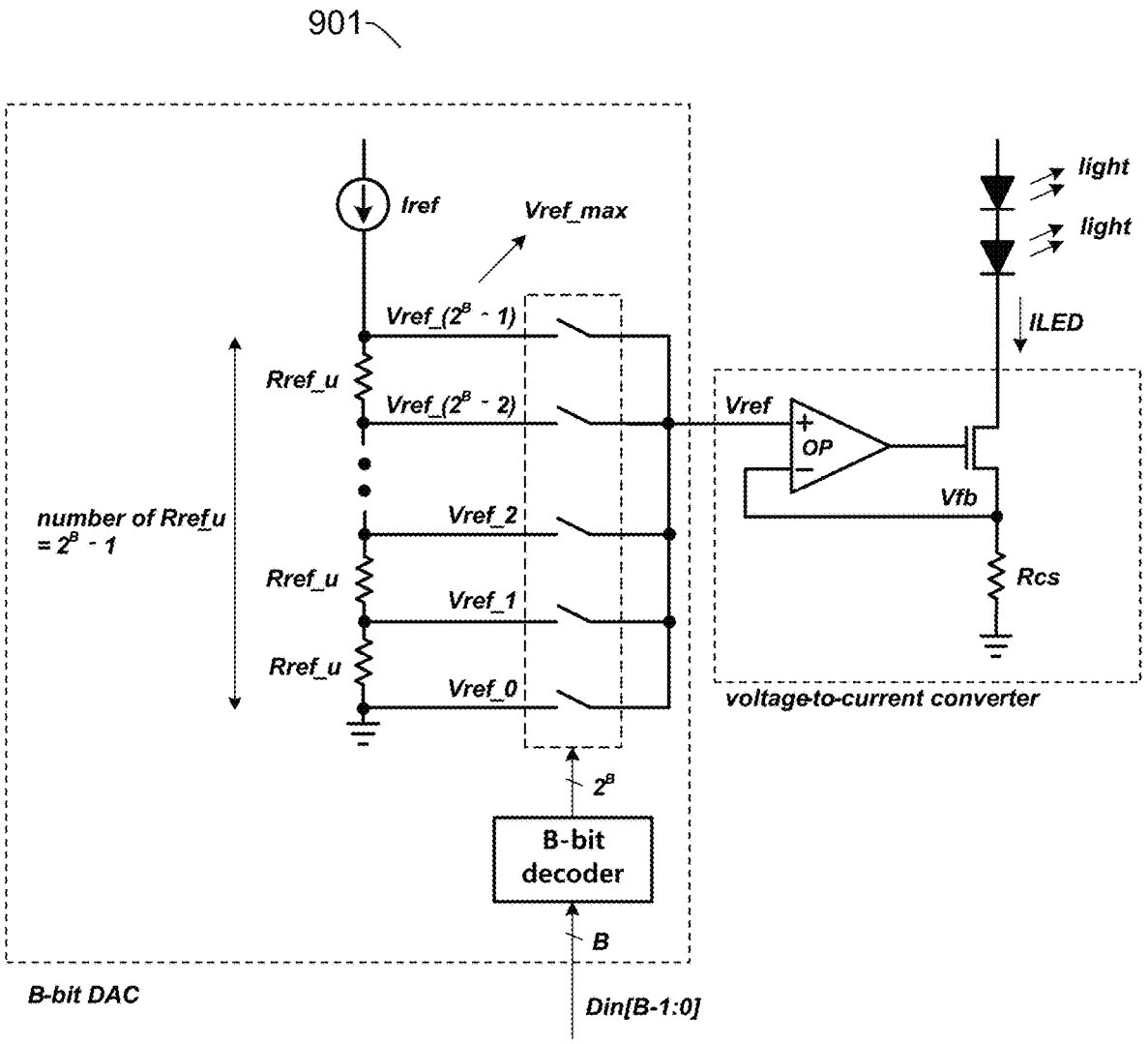
Fig. 1 (Prior Art)
FIG. 1 shows a schematic diagram of a prior art back-light LED driver.
Figure 2:
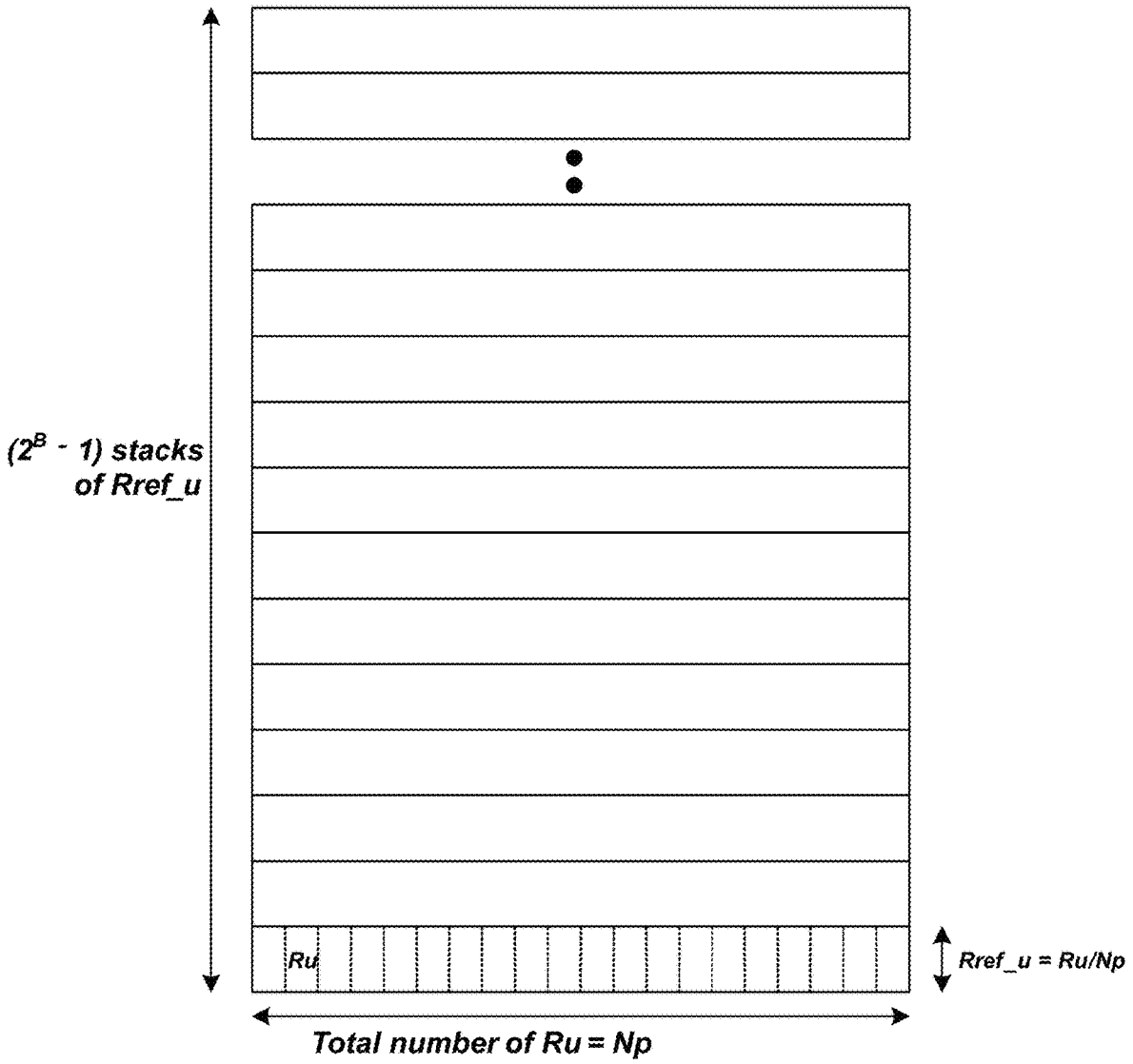
Fig. 2 (Prior Art)
FIG. 2 shows a layout diagram of the resistors forming the resistor string of the DAC in FIG. 1.

If the total bit number B of the DAC input code and Np are large to an extent, the total number of Ru's in FIG. 4 and FIG. 5 is approximately only four times less than that for the prior art in FIG. 1 and FIG. 2. Another advantage of the circuit in FIG. 4 is that the number of bits for the sub-decoder 130 is also reduced by 1 bit, compared to that in FIG. 1. Since area and complexity of a decoder increases exponentially with an additional bit as afore-mentioned, the segmentation of the decoder circuit into plural sub-decoders can lead to reduction of area and complexity by approximately two times in this embodiment.

Figure 6:
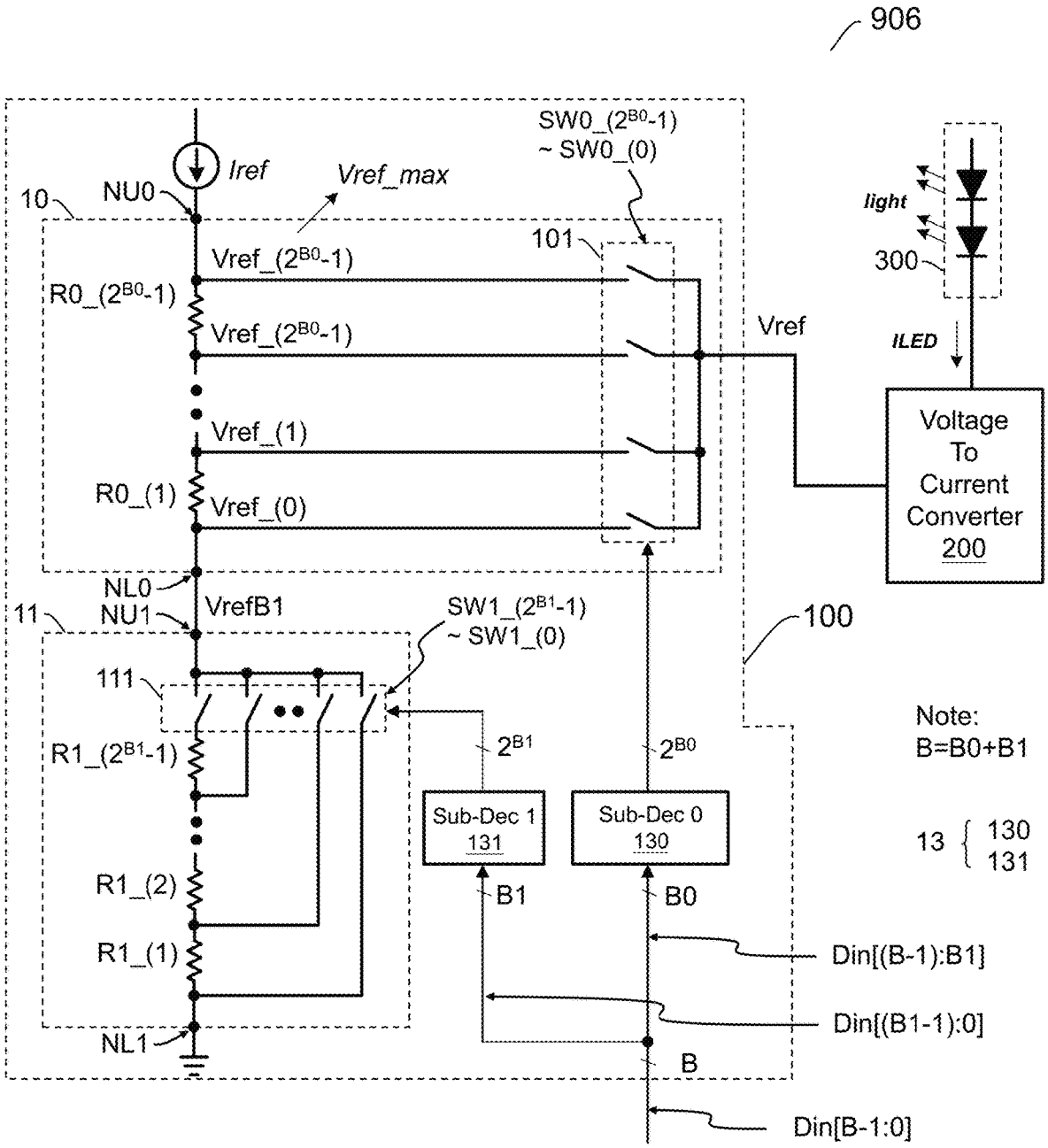
FIG. 6 shows a schematic diagram of an LED driver (906) according to an embodiment of the present invention.

FIG. 6 shows a schematic diagram of an LED driver (906) according to an embodiment of the present invention. The proposed DAC reference circuit can be generalized with segmentation by B1-bit first-type sub-DAC circuit 10 and B0-bit second sub-DAC circuit 11, as shown in FIG. 6. In this embodiment, the total bit number B is equal to B0+B1, wherein B0 and B1 are integers equal to or higher than 1. Note that when B1 is equal to 1, the embodiment in FIG. 6 is identical to that of FIG. 4.

In one embodiment, the sub-DAC circuit 10 in FIG. 6 is similar to FIG. 4 and is different in that each of the resistors R0_(1)~R0_($2^{B0}$–1) of the first-type sub-DAC circuit 10 in FIG. 6 has identical resistance of $2^{B1}$*Rref_u.

In one embodiment, the second-type sub-DAC circuit 11 in FIG. 6 includes a second resistor string and a switch network 111. The second resistor string includes plural resistors R1_(1) R1_($2^{B1}$–1). The switch network 111 includes corresponding number of switches SW1_(0)~SW1_($2^{B1}$–1). Each of the resistors R1_(1)~R1_($2^{B1}$–1) has resistance of Rref_u. One end of each of the switches SW1_(0)~SW1_($2^{B1}$–1) is connected respectively to the lower end of the resistor R1_(1), joint nodes between any two neighboring resistors R1_(1)~R1_($2^{B1}$–1), and the upper end of R1_($2^{B1}$–1). The other ends of the switches SW1_(0)~SW1_($2^{B1}$–1) are connected together to the upper terminal NU1 of the second-type sub-DAC 11. Note that the other ends of the switches SW1_(0)~SW1_($2^{B1}$–1) can be alternatively connected together to the lower terminal NL1 of the second-type sub-DAC 11 and the functions keep the same.

The switches SW1_(0)~SW1_($2^{B1}$–1) are configured to select one node among the upper terminal of the resistor R1_($2^{B1}$–1), the lower terminal of the resistor R1_(1), or a joint node between two neighboring resistors, by the lower B1 bits of the DAC input code, to be conducted to the upper terminal NU1, so as to select a portion of the second resistor string to be connected in series to the first-type sub-DAC circuit 10 and to determine the voltage level of Vref_0 (i.e. the voltage drop VrefB1, of the selected portion of the second resistor string).

Thus, the DAC output voltage Vref of the embodiment in FIG. 6 can then be derived as $$\text{Vref}=I_{ref}\cdot(R_{SW}+R_{ref_u}\cdot(\text{decimal value of } Din[B1-1]))+I_{ref}\cdot(2^{B1}\cdot R_{ref_u}\cdot(\text{decimal value of } Din[B0-1]))$$

$$=I_{ref}\cdot R_{ref_u}\cdot(\text{decimal value of } Din[B-1:0])+I_{ref}\cdot R_{SW} \quad \text{Eq. (4')}$$

Note that the Eq. (4') is identical to the Eq. (4).

Also note that, from one perspective, the reference current Iref always flows through all the series resistors of the first resistor string in the first-type sub-DAC circuit and does not flow to any voltage division selection switch (e.g. one of SW0_(0)~SW0_($2^{B0}$−1) in FIG. 6). On the other hand, the reference current Iref flows through one of the selection switches (e.g. one of SW1_(0)~SW1_($2^{B1}$−1) in FIG. 6) and also flows at the same time through a portion of the series resistors of the second resistor string, selected by the B1 bits the DAC input code, of the second-type sub-DAC circuit 11.

Figure 7:
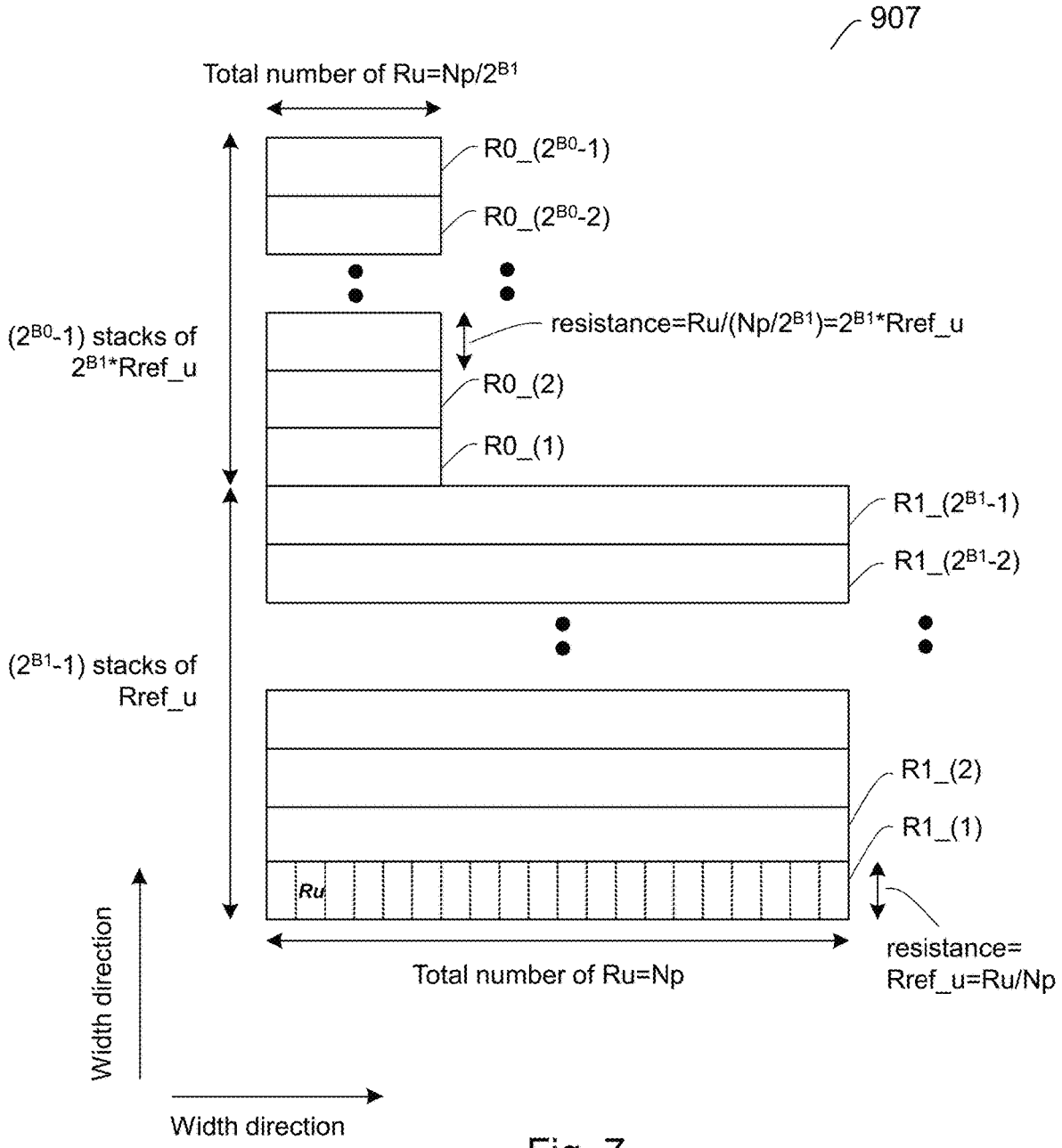
FIG. 7 shows a layout diagram of the resistors forming the resistor string of the DAC in FIG. 6.

FIG. 7 shows a layout diagram of the resistors forming the resistor string of the DAC in FIG. 6. Each of the resistors R0_(1)~R0_($2^{B0}$−1) having resistance of $2^{B1}$*Rref_u in FIG. 6 can be physically implemented using a parallel connection of only (Np/$2^{B1}$) Ru's, as shown in FIG. 7. Thus, the total number of Ru's in FIG. 7 becomes $$\text{Total number of Ru's in Fig. 7} = N_P\cdot(2^{B1}-1)+\left(\frac{N_P}{2^{B1}}\right)\cdot(2^{B0}-1) \quad \text{Eq. (6)}$$

A resistor area ratio ARR between Eq. (6) and Eq. (3) can be derived as below.

$$\text{resistor area ratio: } ARR = \frac{(2^{B1}-1)+(2^{B-B1}-1)/2^{B1}}{(2^{B}-1)} \sim \frac{2^{B1}+2^{B-2B1}}{2^{B}} = 2^{B1-B}+2^{-2B1} \quad \text{Eq. (7)}$$

Figure 8:
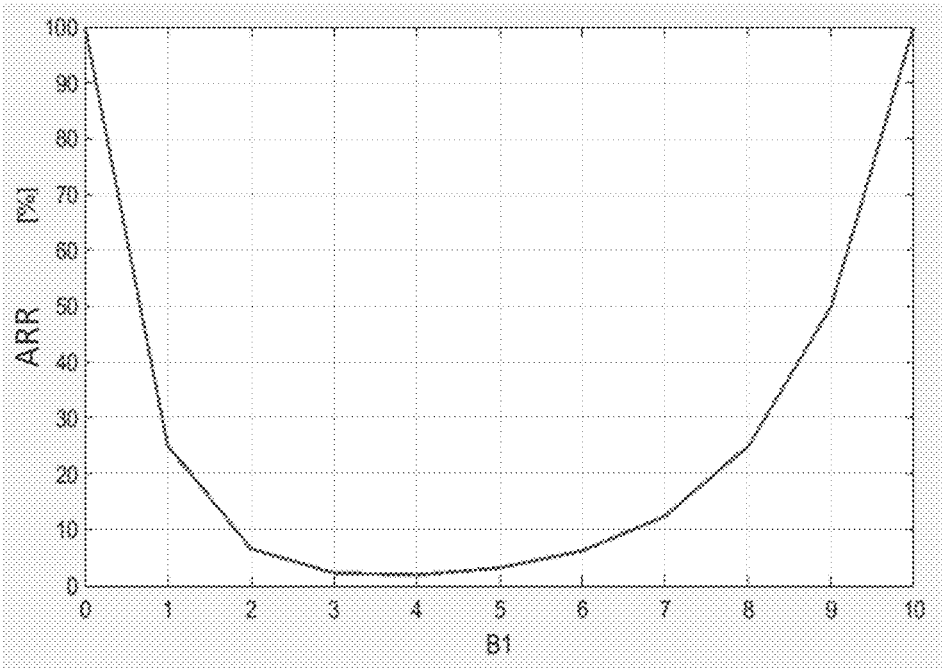
FIG. 8 shows characteristic curve of resistor area reduction ratio according to an embodiment of the present invention.

Note that B is equal to B0+B1. An exemplary resistor area ratio ARR of Eq. (7) is graphically illustrated in FIG. 8 with respect to B1, where the total bit number B of the DAC input code is assumed to be 10. As shown in FIG. 8, the resistor area ratio ARR is minimized when B1 is 4, wherein B0 is 6. At the minimum, when B1 is 4, the physical layout area of the resistors of FIG. 7 is only 1.85% of the original area needed in prior art of FIG. 1. In addition to the resistor area reduction, the decoder area can also be greatly reduced. In general, the area of a decoder is quadratically proportional to the number of bits of its input code. Thus, the decoder area reduction ratio ARD is derived as $$\text{decoder area ratio: } ARD = \frac{2^{B1}+2^{B-B1}}{2^{B}} = 2^{B1-B}+2^{-B1} \quad \text{Eq. (8)}$$

Figure 9:
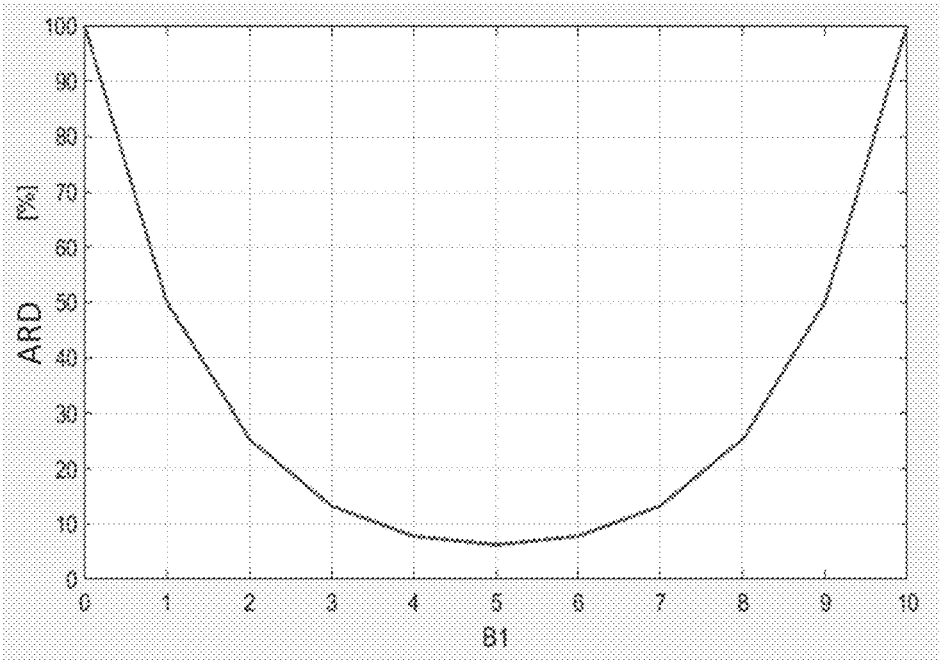
FIG. 9 shows characteristic curve of decoder area reduction ratio according to an embodiment of the present invention.

With B=10, Eq. (8) is graphically illustrated in FIG. 9 with respect to B1. Obviously, it is minimized when B1 is 5, i.e. half of B. At the minimum, when B1 is 5, the decoder area is only 6.25% of the original decoder area needed in prior art of FIG. 1. Even if B=4 is selected for resistor area minimization, the decoder area is only 7.81% of the original decoder area.

Note that, when the resistors are implemented by material such as the aforementioned poly-silicon resistor, an aspect ratio (i.e. width divided by length) of a fundamental resistor (e.g. R1_(1)) having resistance of Rref_u in the second resistor string of the sub-DAC 11 can be much larger than 1, or larger than 5, or larger than 10, as shown in FIG. 7, due to a larger resistance per square of the resistor material. Note that the current flowing through a resistor flows along the direction of length geometry. In other words, the resistance Rref_u is relatively smaller than the resistance per square of the resistor material.

According the present invention, a fundamental resistor (e.g. R0_(1)) in the first resistor string of the sub-DAC 10 has a higher resistance (e.g. $2^{B1}$*Rref_u), and the aspect ratio of the fundamental resistor in the first resistor string becomes smaller (i.e. 1/$2^{B1}$). The area is also shrunk proportional to the shrinking ratio of the aspect ratio providing the lengths of these fundamental resistors (e.g. R0_(1), R1_(1)) are the same. In one embodiment, resistance of the unit resistor Ru is larger than the resistance per square of the poly-silicon since its aspect ratio is smaller than 1 as shown in FIG. 7.

In addition to 2-part segmentation as described in the aforementioned embodiments, the DAC reference circuit can be extended for more segmentations. In other words, DAC reference circuit of the present invention can be segmented into more sub-DAC circuits as the following embodiment.

Figure 10:
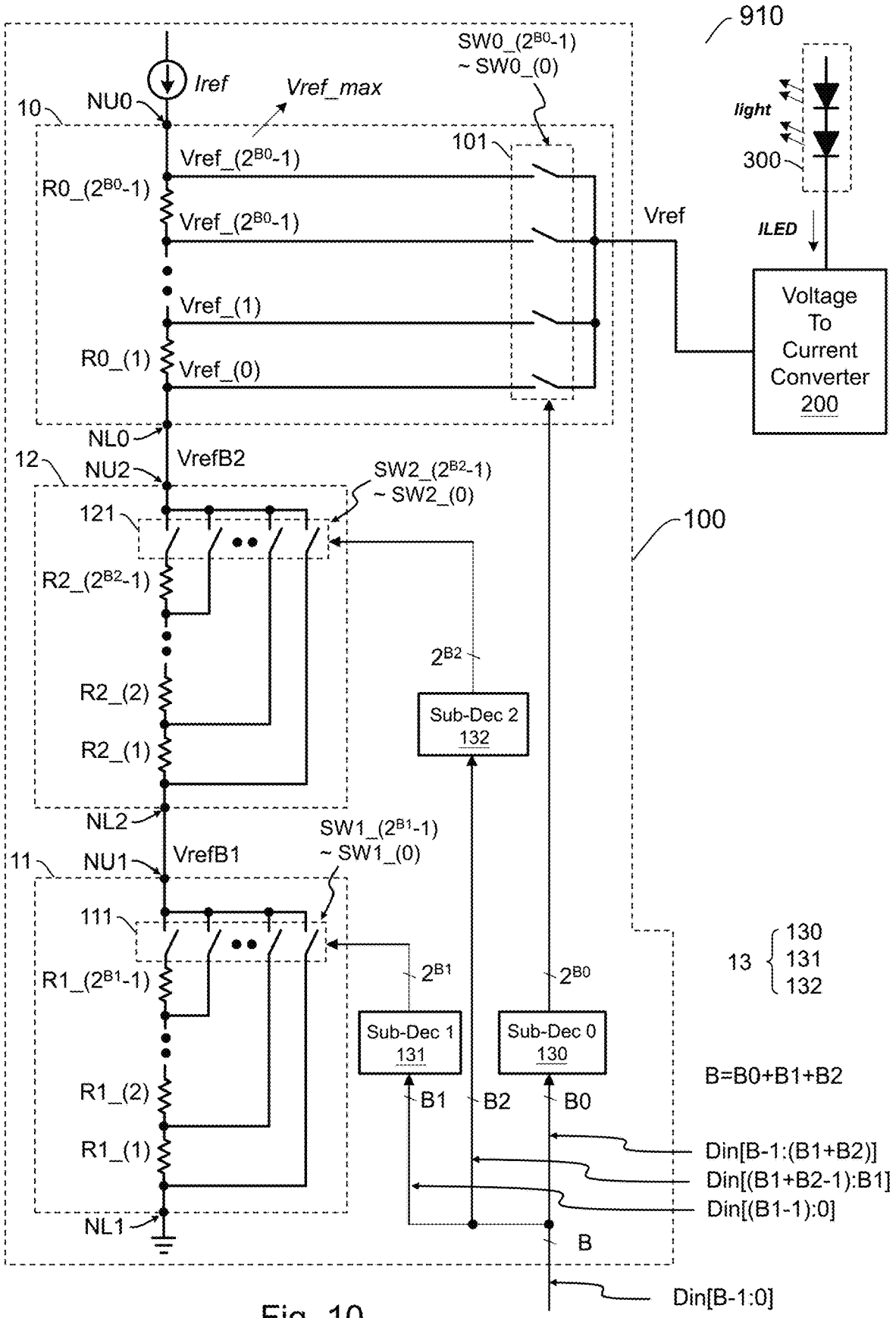
FIG. 10 shows a schematic diagram of an LED driver according to an embodiment of the present invention.

FIG. 10 shows a schematic diagram of an LED driver (910) according to an embodiment of the present invention. In this embodiment, the DAC reference circuit 100 in FIG. 10 includes a first-type sub-DAC circuit 10, a second-type sub-DAC circuit 11, and another second-type sub-DAC 12. In this embodiment, the first-type sub-DAC circuit 10, the second-type sub-DAC circuit 11 and the second-type sub-DAC 12 are coupled in series and are controlled by the upper B0 bits, the lower B1 bits and the middle B2 bits of the B-bit DAC input code to generate the DAC output voltage Vref, wherein B is equal to B0+B1+B2.

Still referring to FIG. 10, more specifically, a reference current Iref is applied to an upper terminal NU0 of the first-type sub-DAC circuit 10. A lower terminal NL0 of the first-type sub-DAC circuit 10 is connected to the upper terminal NU2 of the second-type sub-DAC circuit 12. A lower terminal NL2 of the second-type sub-DAC circuit 12 is connected to the upper terminal NU1 of the second-type sub-DAC circuit 11. A lower terminal NL1 of the second-type sub-DAC circuit 11 is connected to a ground node. The DAC output voltage Vref is a sum of the voltage drop VrefB1 across the second-type sub-DAC circuit 11, the voltage drop (VrefB2−VrefB1) across the second-type sub-DAC circuit 12 and the voltage division of the voltage drop across the first-type sub-DAC circuit 10. The voltage drop (VrefB2−VrefB1) across the second-type sub-DAC circuit 12 is a product of the series resistance of second-type sub-DAC circuit 12 and the reference current Iref, wherein the series resistance of second-type sub-DAC circuit 12 is controlled by the B2 bits of the DAC input code.

Still referring to FIG. 10, the sub-DAC circuit 10 and the second-type sub-DAC circuit 11 in FIG. 10 are controlled by the upper B0 bits and the lower B1 bits of the DAC input code respectively. Each of the resistors R0_(1)~R0_($2^{B0}$−1) of the first-type sub-DAC circuit 10 in FIG. 10 has identical resistance of $2^{(B1+B2)}$*Rref_u. Each of resistors R1_(1)~R1_($2^{B1}$−1) has resistance of Rref_u. The switches SW1_(0)~SW1_($2^{B1}$−1) are configured to select one node among the upper terminal of the resistor R1_($2^{B1}$−1), the lower terminal of the resistor R1_(1), or a joint node between two neighboring resistors, by the lower B1 bits of the DAC input code, to be conducted to the upper terminal NU1, so as to determine the voltage level of VrefB1.

The second-type sub-DAC circuit 12 in FIG. 10 includes resistors R2_(1)~R2_($2^{B2}$−1), and corresponding number of switches SW2_(0)~SW2_($2^{B2}$−1). Each of resistors R2_(1)~R2_($2^{B2}$−1) has resistance of $2^{B1}$*Rref_u The switches SW2_(0)~SW2_($2^{B2}$−1) are configured to select one node among the upper terminal of the resistor R2_($2^{B2}$−1), the lower terminal of the resistor R2_(1), or a joint node between two neighboring resistors, by the middle B2 bits of the DAC input code, to be conducted to the upper terminal NU2, so as to determine the voltage level of the voltage drop (VrefB2−VrefB1) between the upper terminal NU2 and the lower terminal NL2. Note that the voltage level of Vref_0 (i.e. the voltage VrefB2) is equal to the sum of the voltage drops of the second-type sub-DAC 12 and the second-type sub-DAC 11. Note that the DAC output voltage Vref is still identical to the final result of Eq. (4), i.e. Vref=Iref*Rref_u*(decimal value of Din[(B−1):0]+Iref*Rsw, wherein the resistance Rsw in this embodiment is a sum of the on resistance of one of the switches SW1_(0)~SW1_($2^{B1}$−1) and one of the switches SW2_(0)~SW2_($2^{B2}$−1). Simple calculation proves that the effect of area reduction of resistors and decoder of the embodiment in FIG. 10 even larger than that of FIG. 6. In fact, the effect of area reduction keeps increasing as the segmentation of the DAC reference circuit increases.

From a perspective, a resistance of the first resistor (e.g. R0_(1)) or the second resistor (e.g. R1_(1) or R2(1)) of the corresponding first-type sub-DAC circuit 10 or the corresponding plural second-type sub-DAC circuits 11 or 12 is arranged to be quadratically proportional to the order of the corresponding portion of the DAC input code, wherein the higher the order of the corresponding portion of the DAC input code occupies, the higher the resistance is.

Figure 11:
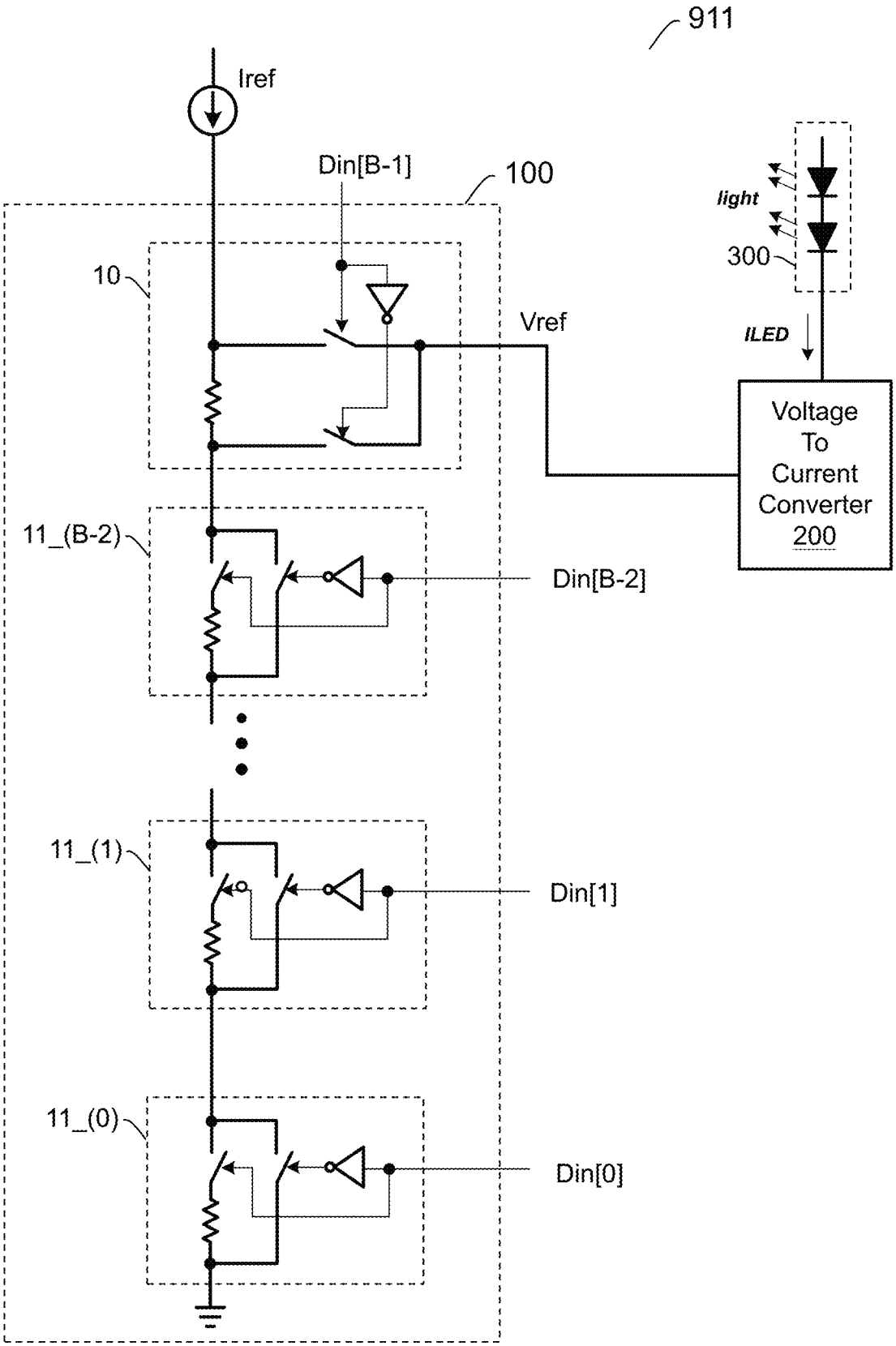
FIG. 11 shows a schematic diagram of an LED driver according to an embodiment of the present invention.

FIG. 11 shows a schematic diagram of an LED driver (911) according to an embodiment of the present invention. Since the total bit number of the DAC input code is B, the DAC can be maximally segmented into B sub divisions. Referring to FIG. 11, the DAC reference circuit 100 includes a first-type sub-DAC circuit 10 and plural second-type sub-DAC circuits 11_(0)~11_(B−2). Each of the sub-DAC circuit 10 and sub-DAC circuits 11_(0)~11_(B−2) includes only 1 resistor. The resistance of the resistor of the sub-DAC circuit 10 is $2^{B-1}$*Rref_u. The resistance values of the resistors of the sub-DAC circuits 11_(0)~11_(B−2) are $2^{j}$*Rref_u respectively, wherein j=0~(B−2). Each bit of the DAC input code is directed to its respective sub-DAC circuit, and 1-bit decoder is implemented with a single inverter for controlling the switches of the sub-DAC circuits. This DAC architecture can be referred to as a binary-type DAC reference circuit and has the maximal area reduction effect. A proper architecture among the aforementioned embodiments can be chosen based on the given linearity specification and area budget of the DAC reference circuit.

Figure 12:
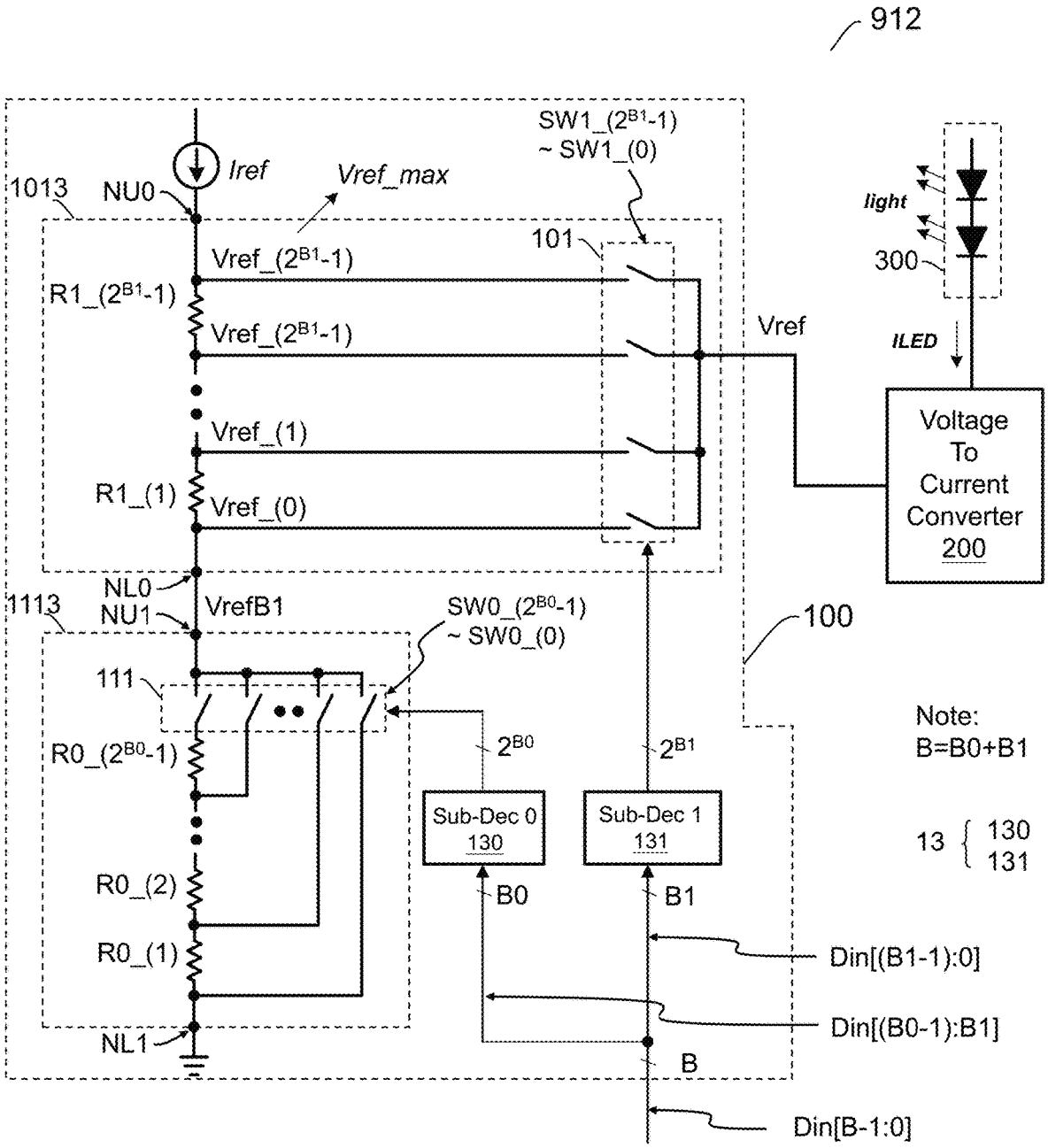
FIG. 12 shows a schematic diagram of an LED driver according to an embodiment of the present invention.

FIG. 12 shows a schematic diagram of an LED driver (912) according to an embodiment of the present invention. The DAC reference circuit 100 in FIG. 12 is similar to FIG. 6 and differs in that, firstly, the first-type sub-DAC circuit 1013 is controlled by the lower B1 bits of the DAC input code while the second-type sub-DAC circuit 1113 is controlled by the upper B0 bits of the DAC input code. Secondly, the resistance of each of the resistors of the first-type sub-DAC circuit 1013 is Rref_u, and the resistance of each of the resistors of the second-type sub-DAC circuit 1113 is $2^{B1}$*Rref_u. In other words, the resistor strings are swapped in between the first-type sub-DAC circuit and the second-type sub-DAC circuit and the control bits are also swapped.

Note that the location of current-flowing switch (e.g. one of the switches SW0_(0)~SW0_($2^{B0}$−1)) of the second-type sub-DAC 1113 in FIG. 12 changes when upper DAC input code changes while for the second-type sub-DAC 11 in FIG. 6 such location changes when lower DAC input code changes. The configuration of FIG. 12 further reduces the impact of the on-resistance variation of the switches on the overall performance. The efficacy of area reduction of resistors and decoders by the proposed segmented DAC design technique remains the same.

The segment swapping technique shown in FIG. 12 can be applied to any aforementioned segmented DAC reference circuit, such as the circuits in FIG. 10. Plus, each segmented sub-DAC circuit can be placed in any part of the overall segmented network, regardless of its assigned portion of the DAC input code. For example, resistors controlled by lower bits in FIG. 10 can be placed at the top part or at middle part as well while the overall functionality of the DAC reference circuit remains the same. Also note that switches of the second-type sub-DAC circuit can also be configured to alternatively switch the lower terminal of the second-type sub-DAC circuit.

Figure 13A:
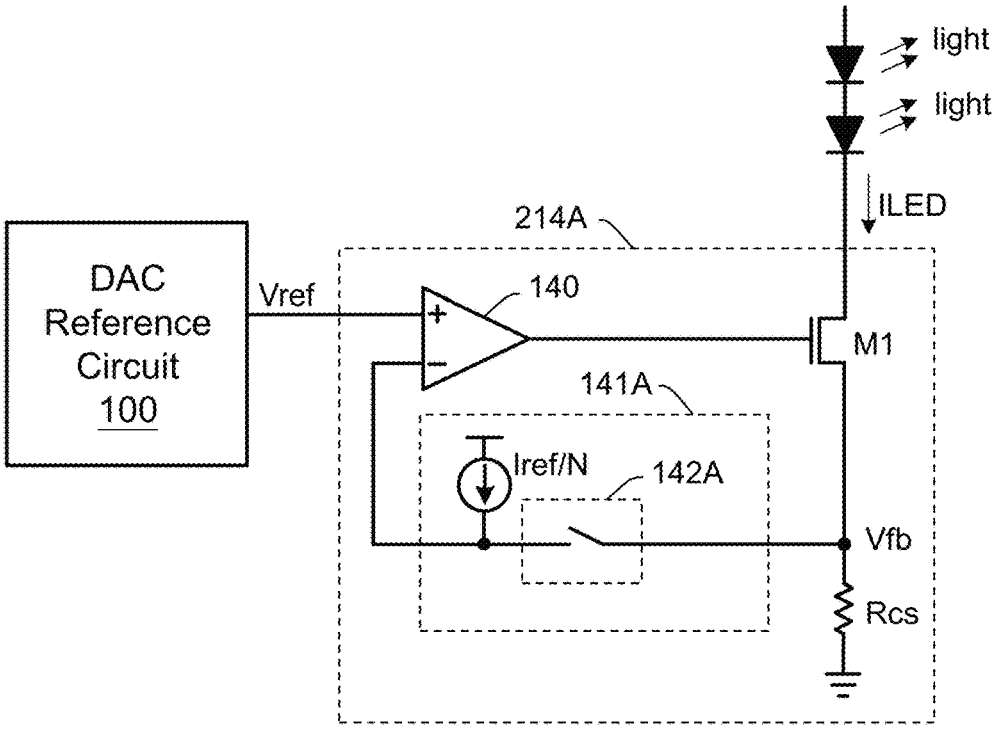
FIG. 13A shows a schematic diagram of a voltage to current converter (214A) of the LED driver according to an embodiment of the present invention.

FIG. 13A shows a schematic diagram of a voltage to current converter (214A) of the LED driver according to an embodiment of the present invention. The voltage to current converter 214A is similar to that shown in FIG. 1 and differs in that the voltage to current converter 214A further includes an additional offset circuit 141A. The offset circuit 141A includes a switch network 142A and a current source Iref/N at the negative input terminal of the opamp as shown in FIG. 13A, wherein N is a number larger than 1. The switch network 142A includes a switch, of which on-resistance is N*Rsw. The switch is always turned on, and thus causes voltage drop of Iref*Rsw between the negative input of the amplifier 140 and the feedback voltage Vfb. This results in Vfb being equal to Vref minus Iref*Rsw, which cancels out the error voltage (Iref*Rsw) shown in Eq. (4) or Eq. (4') for accurate LED current generation. A constant offset of Iref/N in the LED current can be minimized by increasing N, which is also helpful for reducing the size of the switch of the switch network 142A since the switch on-resistance should be increased accordingly.

Note that the switch network can be configured corresponding to the configuration of the sub-DAC circuits, so that the switch resistance Rsw is equal to the on resistance of the switch of the second-type sub-DAC circuit 11 in FIG. 6, or is equal to the sum of the on resistance of the switches coupled in series along the current path in the second-type sub-DAC circuits in FIG. 10, FIG. 11 or FIG. 12.

Figure 13B:
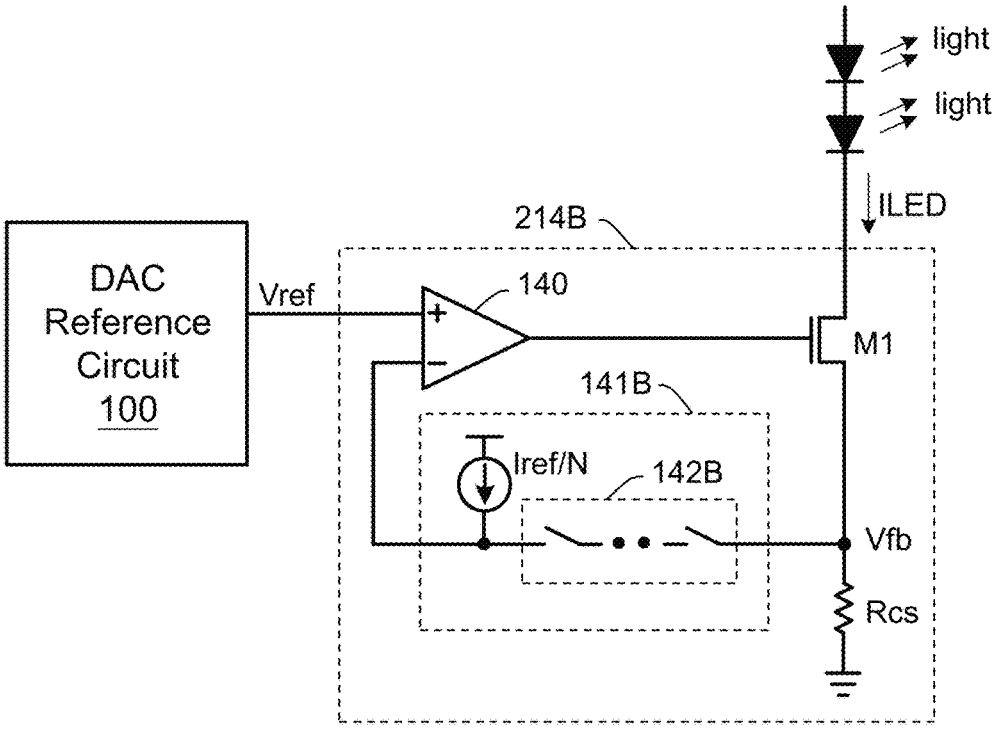
FIG. 13B shows a schematic diagram of a voltage to current converter (214B) of the LED driver according to an embodiment of the present invention.

FIG. 13B shows a schematic diagram of a voltage to current converter (214B) of the LED driver according to an embodiment of the present invention. The voltage to current converter 214B is similar to 214A and differs in that the switch network 142B of the offset circuit 141B includes plural switches coupled in series. The series connected switches correspond to for example the switches of the sub-DAC circuit 11~12 in FIG. 10, or correspond to the switches of the sub-DAC circuits 11_(0)~11_(B−2) in FIG. 11.

Figure 13C:
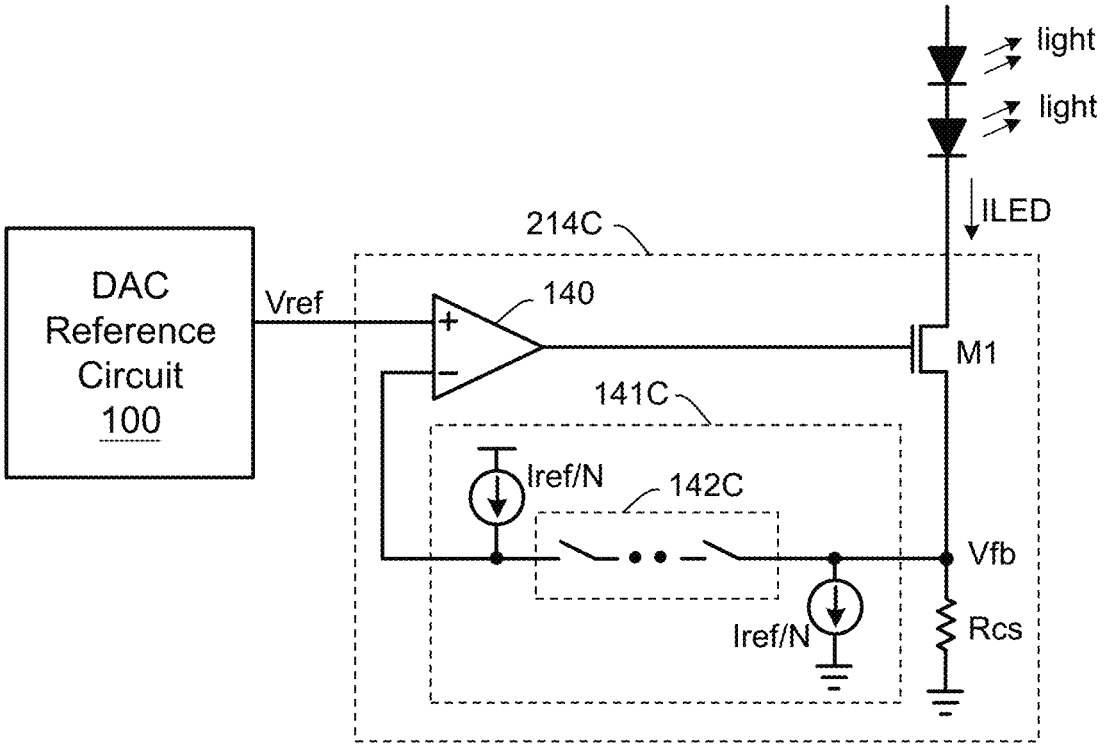
FIG. 13C shows a schematic diagram of a voltage to current converter (214C) of the LED driver according to an embodiment of the present invention.

FIG. 13C shows a schematic diagram of a voltage to current converter (214C) of the LED driver according to an embodiment of the present invention. The voltage to current converter 214C is similar to 214B and differs in that the offset circuit of the voltage to current converter 214C further includes a current sink circuit for providing a sinking current Iref/N to cancel out the error caused by the current source Iref/N while providing the cancellation of the error voltage Iref*Rsw.

Figure 14:
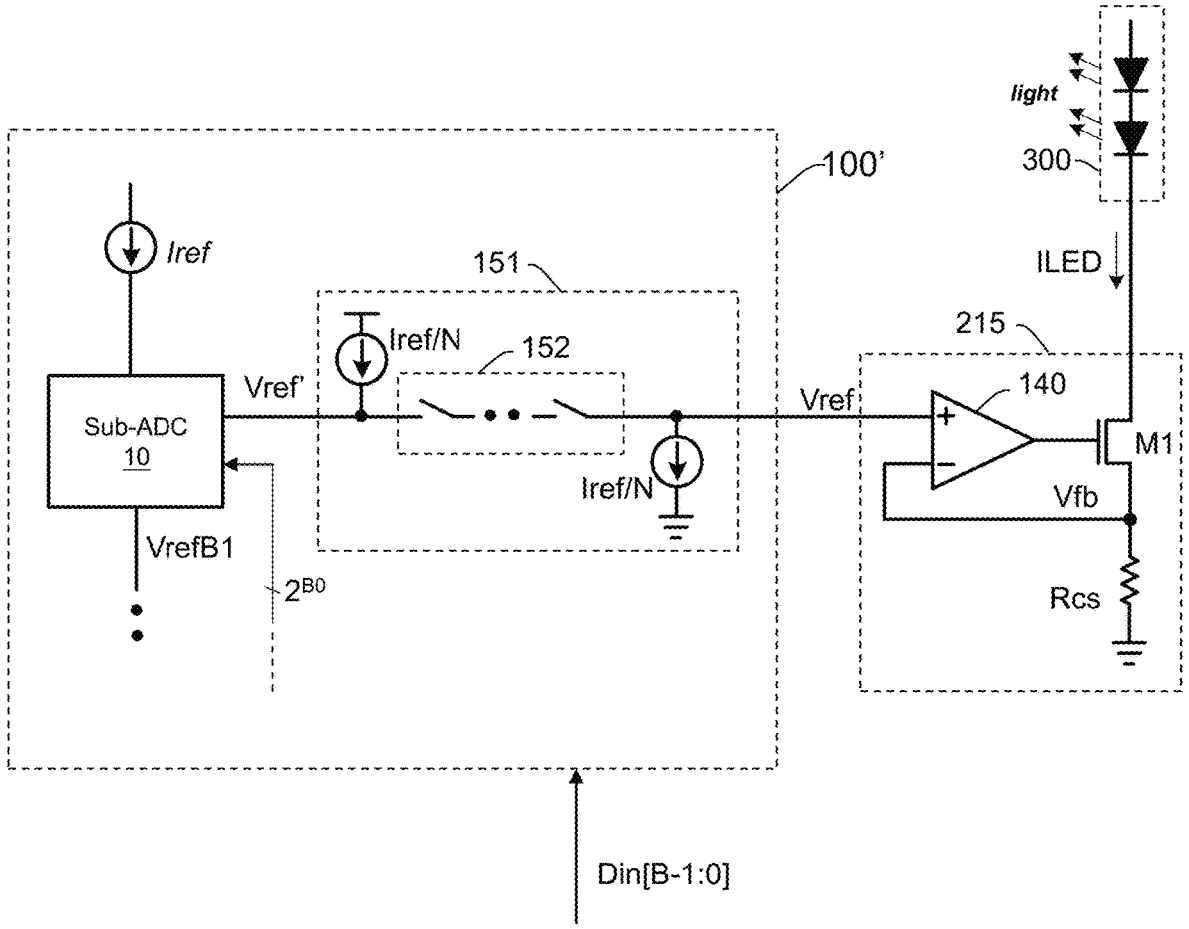
FIG. 14 shows a schematic diagram of an LED driver according to an embodiment of the present invention.

The error voltage can alternatively be cancelled out at the DAC reference circuit. FIG. 14 shows a schematic diagram of an LED driver according to an embodiment of the present invention. The DAC reference circuit 100' further includes an offset circuit 151 which is configured to cancel the error voltage Iref*Rsw at the output (Vref') of the DAC reference circuit 100'. The offset circuit 151 is coupled between the reference output terminal of the sub-DAC 10 (i.e. Vref') and the input of the voltage to current converter 200 (i.e. Vref). The offset circuit 151 in this embodiment is identical to the aforementioned offset circuit 141C. Hence the configuration and operation of the offset circuit 151 will not be repeated herein. Note that the voltage to current converter 215 does not need offset cancellation circuitries in this embodiment.

The present invention has been described in considerable detail with reference to certain preferred embodiments thereof. It should be understood that the description is for illustrative purpose, not for limiting the broadest scope of the present invention. An embodiment or a claim of the present invention does not need to achieve all the objectives or advantages of the present invention. The title and abstract are provided for assisting searches but not for limiting the scope of the present invention. Those skilled in this art can readily conceive variations and modifications within the spirit of the present invention. For example, to perform an action "according to" a certain signal as described in the context of the present invention is not limited to performing an action strictly according to the signal itself, but can be performing an action according to a converted form or a scaled-up or down form of the signal, i.e., the signal can be processed by a voltage-to-current conversion, a current-to-voltage conversion, and/or a ratio conversion, etc. before an action is performed. It is not limited for each of the embodiments described hereinbefore to be used alone; under the spirit of the present invention, two or more of the embodiments described hereinbefore can be used in combination. For example, two or more of the embodiments can be used together, or, a part of one embodiment can be used to replace a corresponding part of another embodiment. In view of the foregoing, the spirit of the present invention should cover all such and other modifications and variations, which should be interpreted to fall within the scope of the following claims and their equivalents.

What is claimed is:

1. A digital-to-analog converter (DAC) reference circuit, configured to operably generate a DAC output voltage according to a DAC input code, comprising:

a first-type sub-DAC circuit, wherein the first-type sub-DAC includes a first resistor string and plural first switches, and receives a reference current to determine a first voltage drop, wherein the first switches are controlled by a first portion of the DAC input code to determine a voltage division of the first voltage drop; and at least one second-type sub-DAC circuit, connected in series with the first-type sub-DAC circuit, wherein the second-type sub-DAC includes a second resistor string and plural second switches, wherein the second switches are controlled by a second portion of the DAC input code to determine a portion of the second resistor string to be connected to the first resistor string and to receive the reference current, wherein the portion of the second resistor string and the reference current determines a second voltage drop;

wherein the DAC output voltage includes a sum of the second voltage drop and the voltage division of the first voltage drop;

wherein the first resistor string includes a first number of first-type resistors which are coupled in series and receives the reference current to generate the first voltage drop across the first resistor string, wherein the first switches are configured to operably select the voltage division of the first voltage drop from an end of one of the first-type resistors according to the first portion of the DAC input code;

wherein the second resistor string includes a second number of second-type resistors which are coupled in series, wherein one of the second switches is turned on, according to the second portion of the DAC input code, to build up a current path for the reference current to an end of one of the second-type resistors, so as to select the portion of the second resistor string to be connected in series to the first resistor string and to receive the reference current to generate the second voltage drop across the portion of the second resistor string;

wherein each of the first resistor has a first resistance and each of the second resistor has a second resistance, wherein a resistance ratio of the first resistance to the second resistance is equal to or larger than the second number when the first portion of the DAC input code is a higher portion than the second portion of the DAC input code, or the resistance ratio is equal to or smaller than a reciprocal of the first number when the second portion of the DAC input code is a higher portion than the first portion of the DAC input code;

wherein each of the first resistors and each of the second resistors are formed by a predetermined material on an integrated circuit;

wherein one of the first resistor and the second resistor having a lower resistance is referred to as a small resistor having a small resistance and one of the first resistor and the second resistor having a higher resistance is referred to as a large resistor having a large resistance;

wherein a first aspect ratio of physical layout of the small resistor is large to an extent that a second aspect ratio of physical layout of the large resistor is smaller than the first aspect ratio and that an area of physical layout of the large resistor is smaller than an area of physical layout of the small resistor;

wherein each of the first aspect ratio and the second aspect ratio is defined by a width divided by a length of physical layout of the corresponding resistor, wherein the reference current flows in a direction along the length.

2. The DAC reference circuit of claim 1, wherein the first aspect ratio of physical layout of the small resistor is larger than 1, or larger than 5, or larger than 1/10, wherein the first aspect ratio is determined by a maximum level of the DAC output voltage, the reference current, a decimal number of the DAC input code and a resistance per square of the predetermined material.

3. The DAC reference circuit of claim 1, wherein a length of each of the first resistor is the same as a length of each of the second resistor.

4. The DAC reference circuit of claim 3, wherein for layout arrangement, each of the first resistor is arranged by a third number of unit resistors connected in parallel and each of the second resistor is arranged by a fourth number of unit resistors connected in parallel, wherein the ratio of the third number to the fourth number is related to the ratio of the first aspect ratio to the second aspect ratio.

5. The DAC reference circuit of claim 1, wherein a resistance per square of the predetermined material is larger than the small resistance to the extent that a second aspect ratio of physical layout of the large resistor is smaller than the first aspect ratio and that an area of physical layout of the large resistor is smaller than an area of physical layout of the small resistor.

6. The DAC reference circuit of claim 5, wherein the resistance per square of the predetermined material is smaller than a unit resistance of the unit resistor.

7. The DAC reference circuit of claim 1, wherein one of the first-type sub-DAC circuit and the second-type sub-DAC circuit having the small resistor is controlled by a lower portion of the DAC input code, and the other of the first-type sub-DAC circuit and the second-type sub-DAC circuit having the large resistor is controlled by a higher portion of the DAC input code.

8. The DAC reference circuit of claim 1, wherein the DAC reference circuit includes plural second-type sub-DAC circuits, wherein the plural second-type sub-DAC circuits and the first-type sub-DAC circuit are coupled in series with the reference current;

wherein the DAC output voltage includes a sum of the voltage drop across the first-type sub-DAC circuit and voltage drops across the plural second-type sub-DAC circuits;

wherein the higher the portion of the DAC input code is configured to control one sub-DAC circuit among the plural second-type sub-DAC circuits and the first-type sub-DAC circuit, the higher a resistance of the first resistor or the second resistor of the one sub-DAC circuit is;

a resistance of the first resistor or the second resistor of the corresponding first-type sub-DAC circuit or the corresponding plural second-type sub-DAC circuits is quadratically proportional to an order of the corresponding portion of the DAC input code, wherein the higher the order of the corresponding portion of the DAC input code occupies, the higher the resistance is.

9. The DAC reference circuit of claim 1, further comprising a decoder circuit which includes a first sub-decoder and a second sub-decoder, wherein the first sub-decoder is configured to operably receive and decode the first portion of the DAC input code to generate plural first control signals to control the first switches respectively, and the second sub-decoder is configured to operably receive and decode the second portion of the DAC input code to generate plural second control signals to control the second switches.

10. The DAC reference circuit of claim 1, for use in generating a driving current in association with a voltage to current converter, wherein the voltage to current converter includes an amplifier and a driving transistor, wherein the amplifier controls the driving transistor to generate the driving current according to the DAC output voltage.

11. The DAC reference circuit of claim 10, wherein the voltage to current converter further includes an offset circuit coupled to a feedback path of the amplifier, wherein the offset circuit includes:

at least one current source, wherein a level of the at least one current source is related to the reference current; and at least one offset switch which is constantly on and configured to receive the at least one current source, wherein a voltage drop across the at least one offset switch cancels out an error voltage of the DAC output voltage, wherein the error voltage is caused by at least one second switch through which the reference current flows, wherein an equivalent on-resistance of the at least one offset switch is related to an on-resistance of the second switch.

12. The DAC reference circuit of claim 1, further comprising an offset circuit coupled to the first sub-DAC circuit, wherein the offset circuit includes:

at least one current source, wherein a level of the at least one current source is related to the reference current; and at least one offset switch which is constantly on and configured to receive the at least one current source, wherein a voltage drop across the at least one offset switch cancels out an error voltage of the DAC output voltage, wherein the error voltage is caused by at least one second switch through which the reference current flows, wherein an equivalent on-resistance of the at least one offset switch is related to an on-resistance of the second switch.

13. A light emitting diode (LED) driver, configured to generate a driving current according to a DAC input code, comprising:

a digital-to-analog converter (DAC) reference circuit, configured to generate a DAC output voltage according to the DAC input code; and a voltage to current converter, which includes an amplifier and a driving transistor, wherein the amplifier controls the driving transistor to generate the driving current according to the DAC output voltage;

wherein the DAC reference circuit includes:

a first-type sub-DAC circuit, wherein the first-type sub-DAC includes a first resistor string and plural first switches, and receives a reference current to determine a first voltage drop, wherein the first switches are controlled by a first portion of the DAC input code to determine a voltage division of the first voltage drop; and at least one second-type sub-DAC circuit, connected in series with the first-type sub-DAC circuit, wherein the second-type sub-DAC includes a second resistor string and plural second switches, wherein the second switches are controlled by a second portion of the DAC input code to determine a portion of the second resistor string to be connected to the first resistor string and to receive the reference current, wherein the portion of the second resistor string and the reference current determines a second voltage drop;

wherein the DAC output voltage includes a sum of the second voltage drop and the voltage division of the first voltage drop;

wherein the first resistor string includes a first number of first-type resistors which are coupled in series and receives the reference current to generate the first voltage drop across the first resistor string, wherein the first switches are configured to operably select the voltage division of the first voltage drop from an end of one of the first-type resistors according to the first portion of the DAC input code;

wherein the second resistor string includes a second number of second-type resistors which are coupled in series, wherein one of the second switches is turned on, according to the second portion of the DAC input code, to build up a current path for the reference current to an end of one of the second-type resistors, so as to select the portion of the second resistor string to be connected in series to the first resistor string and to receive the reference current to generate the second voltage drop across the portion of the second resistor string;

wherein each of the first resistor has a first resistance and each of the second resistor has a second resistance, wherein a resistance ratio of the first resistance to the second resistance is equal to or larger than the second number when the first portion of the DAC input code is a higher portion than the second portion of the DAC input code, or the resistance ratio is equal to or smaller than a reciprocal of the first number when the second portion of the DAC input code is a higher portion than the first portion of the DAC input code;

wherein each of the first resistors and each of the second resistors are formed by a predetermined material on an integrated circuit;

wherein one of the first resistor and the second resistor having a lower resistance is referred to as a small resistor having a small resistance and one of the first resistor and the second resistor having a higher resistance is referred to as a large resistor having a large resistance;

wherein a first aspect ratio of physical layout of the small resistor is large to an extent that a second aspect ratio of physical layout of the large resistor is smaller than the first aspect ratio and that an area of physical layout of the large resistor is smaller than an area of physical layout of the small resistor;

wherein each of the first aspect ratio and the second aspect ratio is defined by a width divided by a length of physical layout of the corresponding resistor, wherein the reference current flows in a direction along the length.

14. The LED driver of claim 13, wherein the first aspect ratio of physical layout of the small resistor is larger than 1, or larger than 5, or larger than 10, wherein the first aspect ratio is determined by a maximum level of the DAC output voltage, the reference current, a decimal number of the DAC input code and a resistance per square of the predetermined material.

15. The LED driver of claim 13, wherein a length of each of the first resistor is the same as a length of each of the second resistor.

16. The LED driver of claim 15, wherein for layout arrangement, each of the first resistor is arranged by a third number of unit resistors connected in parallel and each of the second resistor is arranged by a fourth number of unit resistors connected in parallel, wherein the ratio of the third number to the fourth number is related to the ratio of the first aspect ratio to the second aspect ratio.

17. The LED driver of claim 13, wherein a resistance per square of the predetermined material is larger than the small resistance to the extent that a second aspect ratio of physical layout of the large resistor is smaller than the first aspect ratio and that an area of physical layout of the large resistor is smaller than an area of physical layout of the small resistor.

18. The LED driver of claim 17, wherein the resistance per square of the predetermined material is smaller than a unit resistance of the unit resistor.

19. The LED driver of claim 13, wherein one of the first-type sub-DAC circuit and the second-type sub-DAC circuit having the small resistor is controlled by a lower portion of the DAC input code, and the other of the first-type sub-DAC circuit and the second-type sub-DAC circuit having the large resistor is controlled by a higher portion of the DAC input code.

20. The LED driver of claim 13, wherein the DAC reference circuit includes plural second-type sub-DAC circuits, wherein the plural second-type sub-DAC circuits and the first-type sub-DAC circuit are coupled in series with the reference current;

wherein the DAC output voltage includes a sum of the voltage drop across the first-type sub-DAC circuit and voltage drops across the plural second-type sub-DAC circuits;

wherein the higher the portion of the DAC input code is configured to control one sub-DAC circuit among the plural second-type sub-DAC circuits and the first-type sub-DAC circuit, the higher a resistance of the first resistor or the second resistor of the one sub-DAC circuit is;

a resistance of the first resistor or the second resistor of the corresponding first-type sub-DAC circuit or the corresponding plural second-type sub-DAC circuits is quadratically proportional to an order of the corresponding portion of the DAC input code, wherein the higher the order of the corresponding portion of the DAC input code occupies, the higher the resistance is.

21. The LED driver of claim 13, wherein the DAC reference circuit further includes a decoder circuit which includes a first sub-decoder and a second sub-decoder, wherein the first sub-decoder is configured to operably receive and decode the first portion of the DAC input code to generate plural first control signals to control the first switches respectively, and the second sub-decoder is configured to operably receive and decode the second portion of the DAC input code to generate plural second control signals to control the second switches.

22. The LED driver of claim 13, wherein the voltage to current converter further includes an offset circuit coupled to a feedback path of the amplifier, wherein the offset circuit includes:

at least one current source, wherein a level of the at least one current source is related to the reference current; and at least one offset switch which is constantly on and configured to receive the at least one current source, wherein a voltage drop across the at least one offset switch cancels out an error voltage of the DAC output voltage, wherein the error voltage is caused by at least one second switch through which the reference current flows, wherein an equivalent on-resistance of the at least one offset switch is related to an on-resistance of the second switch.

23. The LED driver of claim 13, wherein the DAC reference circuit further includes an offset circuit coupled to the first sub-DAC circuit, wherein the offset circuit includes:

at least one current source, wherein a level of the at least one current source is related to the reference current; and at least one offset switch which is constantly on and configured to receive the at least one current source, wherein a voltage drop across the at least one offset switch cancels out an error voltage of the DAC output voltage, wherein the error voltage is caused by at least one second switch through which the reference current flows, wherein an equivalent on-resistance of the at least one offset switch is related to an on-resistance of the second switch.

* * * * *